US010527273B2

(12) United States Patent
Lui et al.

(10) Patent No.: US 10,527,273 B2
(45) Date of Patent: Jan. 7, 2020

(54) LIGHTING FIXTURE WITH BRANCHING HEAT SINK AND THERMAL PATH SEPARATION

(71) Applicant: CREE, INC., Durham, NC (US)

(72) Inventors: Nelson Man Hoi Lui, Tai Po (HK); Felix Chi Hoi Mung, Kowloon (HK); Gauss Ho Ching So, Kowloon (HK); Alan Hoi Leung Ng, Shatin (HK); Sandeep Pawar, Elmhurst, IL (US)

(73) Assignee: IDEAL INDUSTRIES LIGHTING, LLC, Sycamore, IL (US)

( * ) Notice: Subject to any disclaimer, the term of this patent is extended or adjusted under 35 U.S.C. 154(b) by 264 days.

(21) Appl. No.: 14/145,559

(22) Filed: Dec. 31, 2013

(65) Prior Publication Data

US 2014/0268730 A1 Sep. 18, 2014

Related U.S. Application Data

(63) Continuation-in-part of application No. 13/840,887, filed on Mar. 15, 2013.

(51) Int. Cl.

| | |
|---|---|
| ***F21V 29/77*** | (2015.01) |
| ***F21V 23/00*** | (2015.01) |
| ***F21V 29/508*** | (2015.01) |
| ***F21W 131/40*** | (2006.01) |

(Continued)

(52) U.S. Cl.

CPC ..... *F21V 29/77* (2015.01); *F21V 23/003* (2013.01); *F21V 23/008* (2013.01); *F21V 29/508* (2015.01); *F21V 29/75* (2015.01); *F21V 29/773* (2015.01); *F21W 2131/40* (2013.01); *F21Y 2115/10* (2016.08)

(58) Field of Classification Search

CPC .... F21V 23/023; F21V 23/003; F21V 23/008; F21V 29/004; F21V 29/508; F21V 29/74; F21V 29/75; F21V 29/763; F21V 29/773; F21V 29/83; F21V 23/004; F21V 23/005; F21V 29/2212; F21Y 2105/10; F21Y 2115/10; F21W 2131/40

See application file for complete search history.

(56) References Cited

U.S. PATENT DOCUMENTS

| | | | |
|---|---|---|---|
| 4,231,080 A | 10/1980 | Compton | 362/298 |
| 6,428,189 B1 | 8/2002 | Hochstein | 362/227 |

(Continued)

OTHER PUBLICATIONS

Office Action from U.S. Appl. No. 13/840,887, dated Sep. 18, 2015.

(Continued)

*Primary Examiner* — Peggy A Neils

(57) ABSTRACT

The present invention relates to different embodiments of lighting fixtures, such as high bay lighting fixtures, comprising improved features. One of these features can be a driver box placement that is displaced from the center of the fixture. In one such embodiment, the driver box can be mounted such that no portion is over the emitters. Another improved features is a heat sink with branching spokes. As they move away from the center of the heat sink, each of the spokes can branch into multiple spokes, which can improve conductive thermal dissipation. Empty spaces can be left between the spokes to improve convective thermal dissipation.

45 Claims, 17 Drawing Sheets

(51) Int. Cl.
*F21V 29/75* (2015.01)
*F21Y 115/10* (2016.01)

(56) References Cited

U.S. PATENT DOCUMENTS

| | | | | |
|---|---|---|---|---|
| 6,511,209 | B1 * | 1/2003 | Chiang | F21V 23/02 362/264 |
| 7,044,620 | B2 | 5/2006 | Van Duyn | 362/227 |
| 7,449,125 | B2 | 10/2008 | Chou | 362/56 |
| 7,771,087 | B2 * | 8/2010 | Wilcox | F21S 8/086 362/183 |
| 7,794,124 | B2 | 9/2010 | Hulsey et al. | 362/477 |
| 7,824,070 | B2 * | 11/2010 | Higley | F21V 15/01 362/249.02 |
| 7,936,561 | B1 | 5/2011 | Lin | 165/185 |
| 8,104,929 | B2 | 1/2012 | Kovalchick et al. | 362/294 |
| 8,143,769 | B2 * | 3/2012 | Li | F21V 29/004 313/46 |
| 8,186,852 | B2 | 5/2012 | Dassanayake et al. | 362/249.02 |
| 8,388,197 | B1 | 3/2013 | Huang et al. | 362/273 |
| 8,471,443 | B2 | 6/2013 | Choi et al. | 313/45 |
| 8,602,579 | B2 | 12/2013 | Van de Ven et al. | 362/96 |
| 8,602,598 | B2 | 12/2013 | Duan et al. | 362/294 |
| 8,692,444 | B2 | 4/2014 | Patel et al. | 313/46 |
| 8,708,522 | B2 * | 4/2014 | Wang | F21V 29/004 362/235 |
| 9,108,261 | B1 * | 8/2015 | Patrick | B23K 1/0008 |
| 9,121,580 | B1 * | 9/2015 | Bryant | F21V 19/00 |
| 9,239,153 | B2 * | 1/2016 | Goodman | F21V 21/00 |
| 9,441,634 | B2 | 9/2016 | Spiro | |
| 9,523,491 | B2 * | 12/2016 | Bailey | F21V 29/507 |
| 9,939,143 | B2 | 4/2018 | Spiro | |
| 2004/0175189 | A1 | 9/2004 | Weber-Rabsilber | 398/201 |
| 2007/0268707 | A1 * | 11/2007 | Smester | F21V 7/10 362/362 |
| 2009/0006856 | A1 | 3/2009 | Low | 439/56 |
| 2009/0290343 | A1 * | 11/2009 | Brown | F21K 9/00 362/235 |
| 2011/0110084 | A1 | 5/2011 | Moon et al. | 362/248 |
| 2011/0110095 | A1 * | 5/2011 | Li | F21V 29/004 362/294 |
| 2011/0141728 | A1 | 6/2011 | Russello | |
| 2011/0204780 | A1 * | 8/2011 | Shum | H05K 1/189 315/35 |
| 2011/0317420 | A1 * | 12/2011 | Jeon | F21S 2/005 362/249.02 |
| 2012/0250321 | A1 * | 10/2012 | Blincoe | F21V 7/00 362/247 |
| 2012/0300454 | A1 * | 11/2012 | Ter-Hovhannisyan | F21V 29/004 362/235 |
| 2012/0300461 | A1 | 11/2012 | Lynch et al. | 362/249.02 |
| 2013/0039056 | A1 | 2/2013 | Cho et al. | 362/235 |
| 2013/0155673 | A1 * | 6/2013 | Wang | F21V 5/007 362/235 |
| 2013/0242557 | A1 * | 9/2013 | Zeng | F21V 29/773 362/249.02 |
| 2014/0192537 | A1 * | 7/2014 | Chung | F28F 3/02 362/294 |
| 2014/0233246 | A1 * | 8/2014 | Lafreniere | F21S 8/026 362/364 |

OTHER PUBLICATIONS

Response to OA from U.S. Appl. No. 13/840,887, dated Nov. 6, 2015.
Office Action from U.S. Appl. No. 13/840,887, dated Mar. 4, 2015.
U.S. Appl. No. 13/828,348, filed Mar. 14, 2013, Edmond, et al.
U.S. Appl. No. 13/834,605, filed Mar. 15, 2013, Lay, et al.
U.S. Appl. No. 13/034,501, filed Feb. 24, 2011, Le, et al.
U.S. Appl. No. 12/947,267, filed Nov. 16, 2010, Lopez, et al.
U.S. Appl. No. 12/566,195, filed Sep. 24, 2009, Van de Ven, et al.
U.S. Appl. No. 12/704,730, filed Feb. 12, 2010, Van de Ven, et al.
U.S. Appl. No. 13/842,307, filed Mar. 15, 2013, Ibbetson, et al.
U.S. Appl. No. 13/442,311, filed Apr. 9, 2012, Lu, et al.
U.S. Appl. No. 13/758,763, filed Feb. 4, 2013, Leung, et al.
U.S. Appl. No. 13/345,215, filed Jan. 6, 2012, Lu, et al.
U.S. Appl. No. 14/145,355, filed Dec. 31, 2013, Lui, et al.
U.S. Appl. No. 13/840,887, filed Mar. 15, 2013, Van de Ven, et al.
U.S. Appl. No. 13/358,901, filed Jan. 26, 2012, Progl, et al.
U.S. Appl. No. 13/441,567, filed Apr. 6, 2012, Kinnune, et al.
Cree® XLamp® CXA2530 LED Product Family Data Sheet, 15 pages.
Cree® XLampe® CXA2520 LED Product Family Data Sheet, 15 pages.
"Cree Reflector Leaflet", Rev. 7 (available at http://www.nata.cn/images/newsletter/pdf/Cree%20Leaflet%20%28rev-7%29.pdf. retrieved Dec. 11, 2013).
"Optimizing PCB Thermal Performance for Cree® XLamp® LEDs" (available at http://www.cree.com/xlamp_app_notes/PCB_Thermal).
Office Action from U.S. Appl. No. 13/840,887; dated Mar. 4, 2016.
Office Action from U.S. Appl. No. 14/145,559; dated Mar. 8, 2016.
Office Action for U.S. Appl. No. 13/840,887; dated Oct. 18, 2016.
Office Action for U.S. Appl. No. 14/145,355; dated Oct. 18, 2016.
Office Action for U.S. Appl. No. 14/145,355; dated May 31, 2017.
Office Action for U.S. Appl. No. 13/840,887; dated Jun. 15, 2017.
Office Action for U.S. Appl. No. 14/145,355; dated Oct. 19, 2017.
Office Action for U.S. Appl. No. 13/840,887; dated Jan. 22, 2018.
Office Action for U.S. Appl. No. 14/145,355; dated Mar. 27, 2018.

* cited by examiner

FIG. 7A
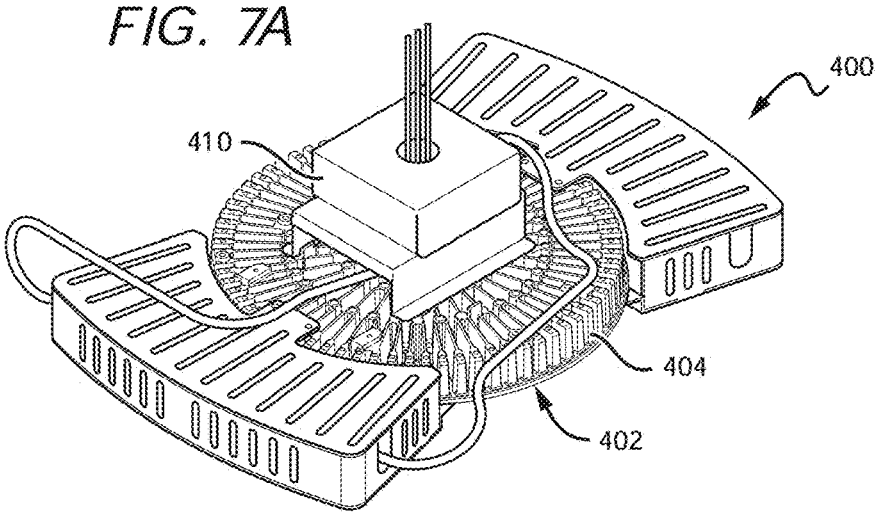
FIG. 7B
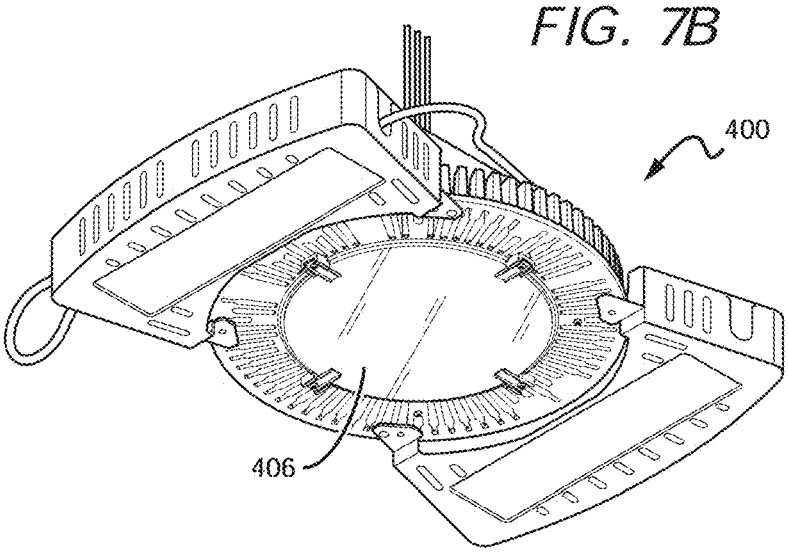
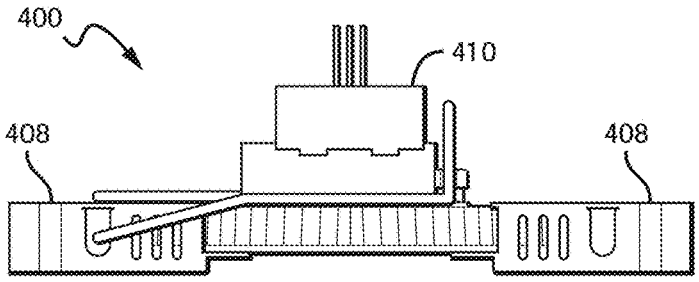
FIG. 7D

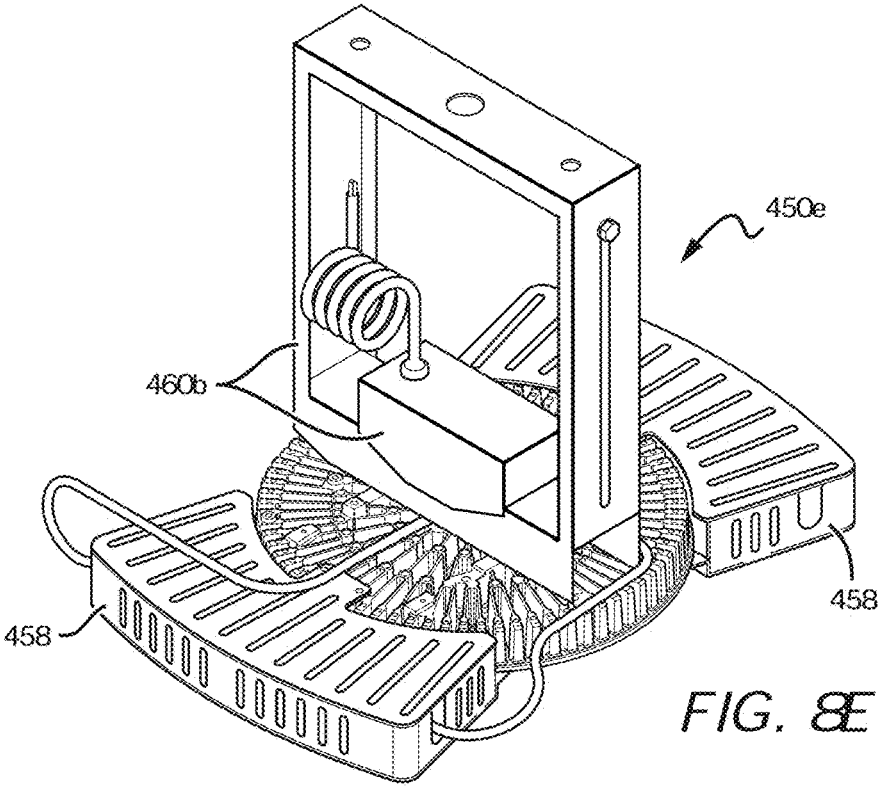
FIG. 8E
FIG. 8F
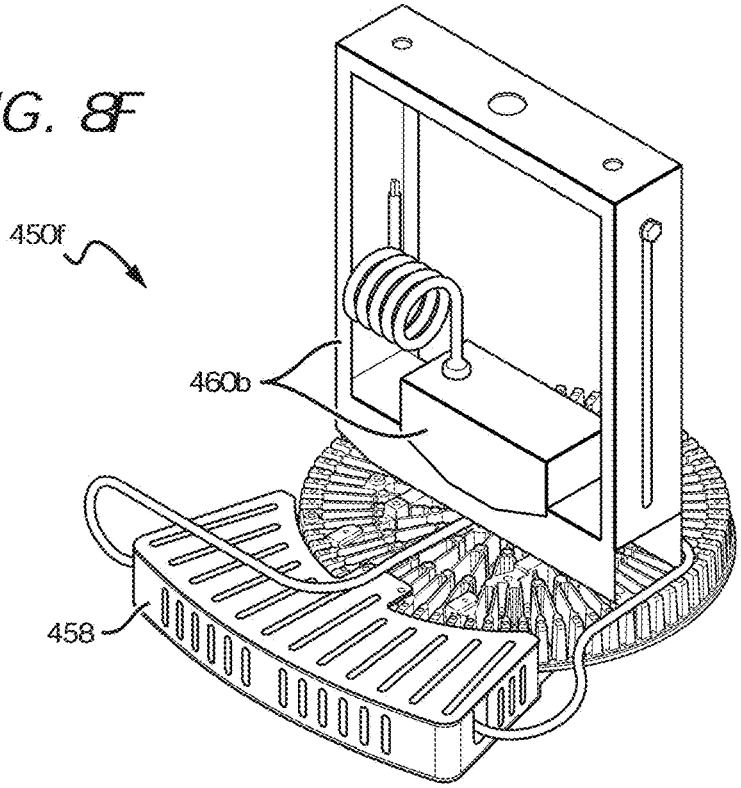

FIG. 8G
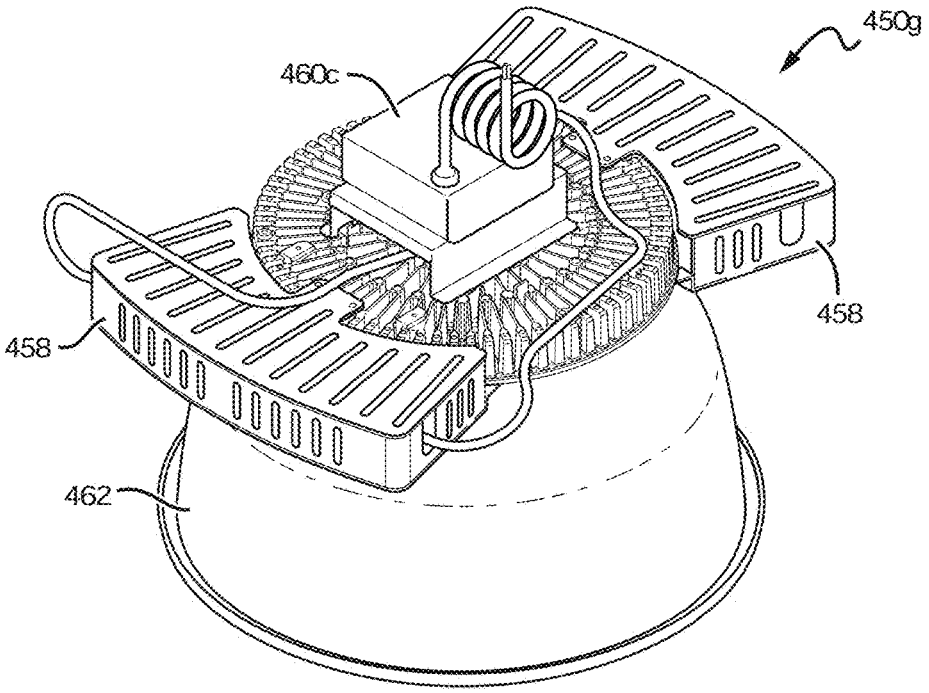
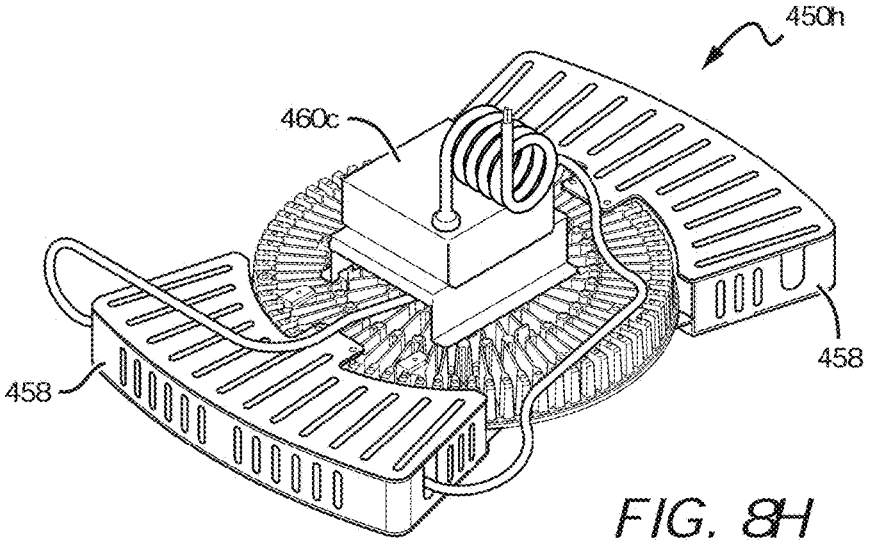
FIG. 8H

FIG. 8I
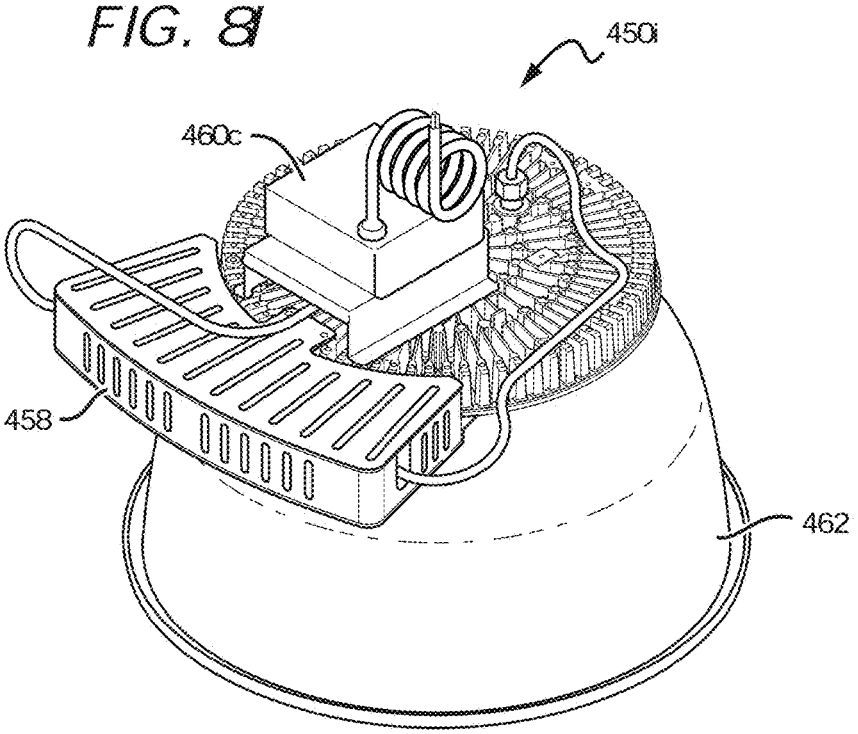
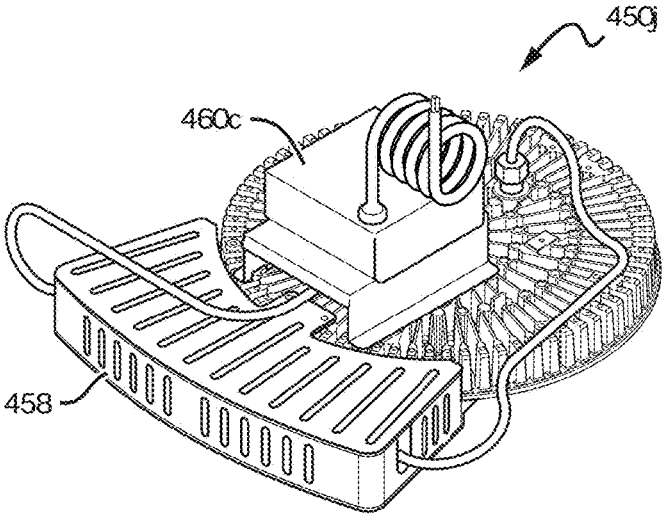
FIG. 8J

FIG. 9A
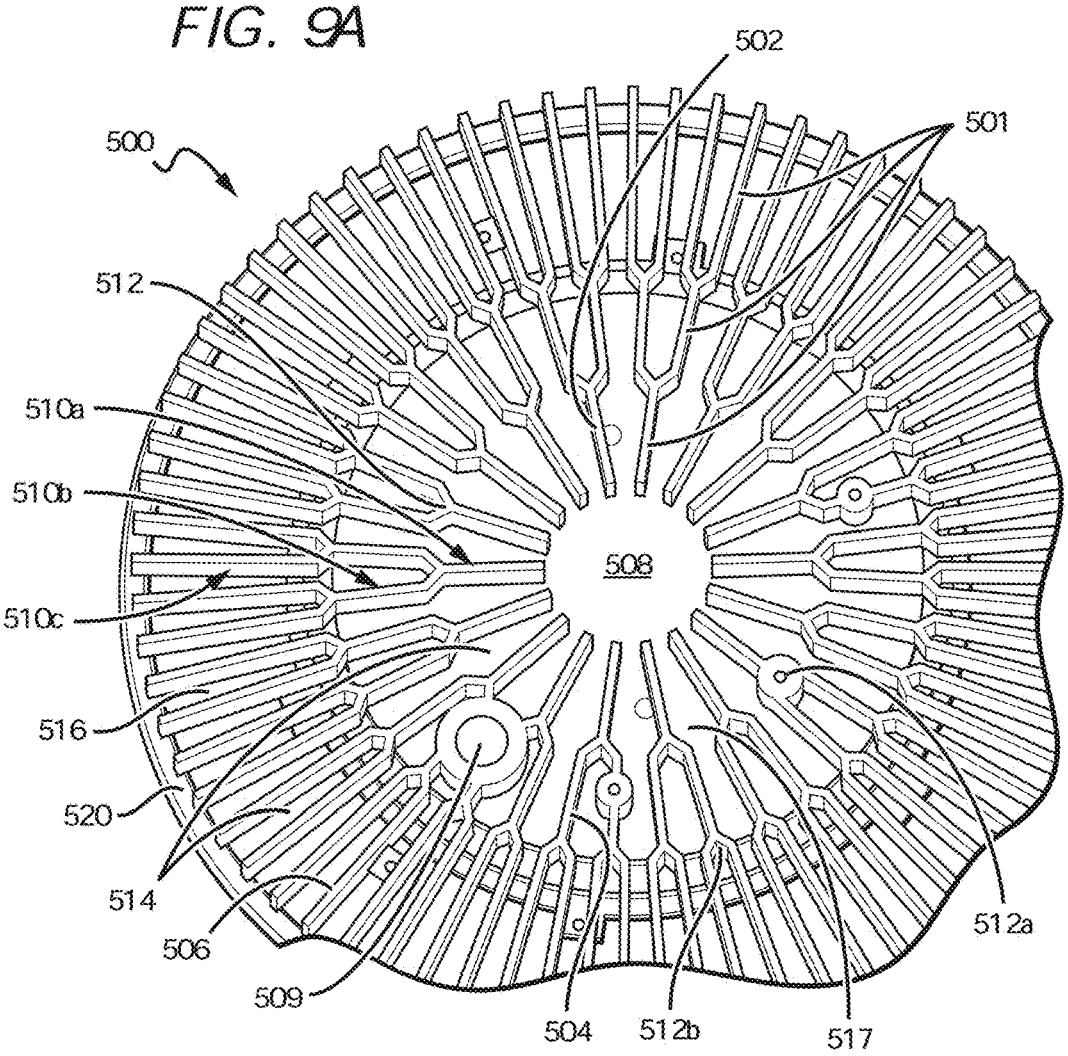
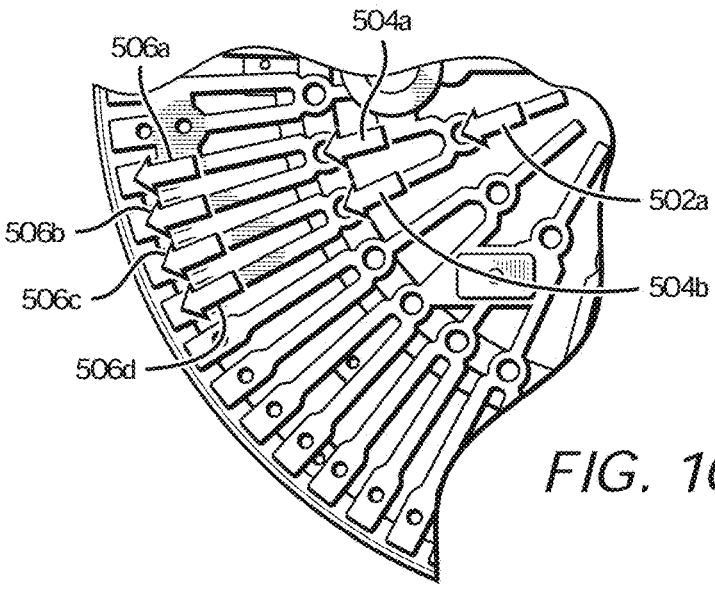
FIG. 10

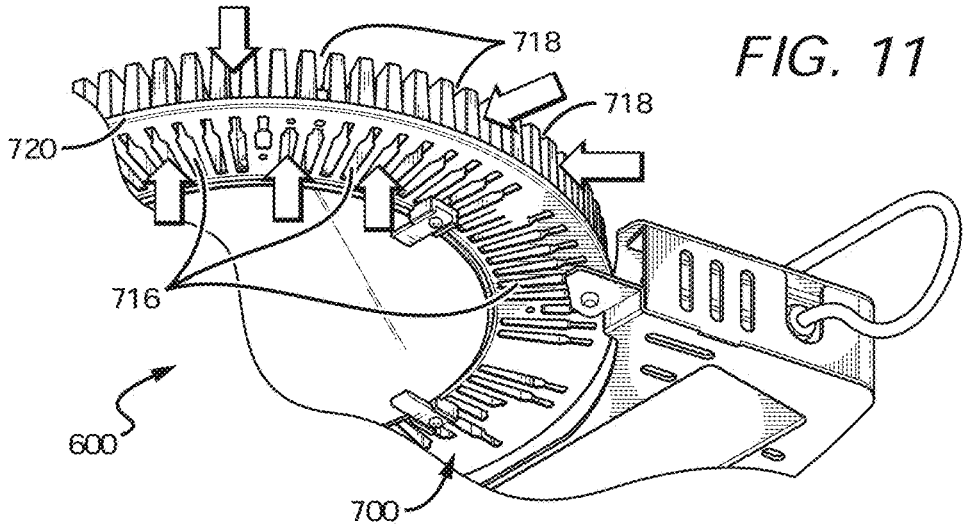
FIG. 11
FIG. 12
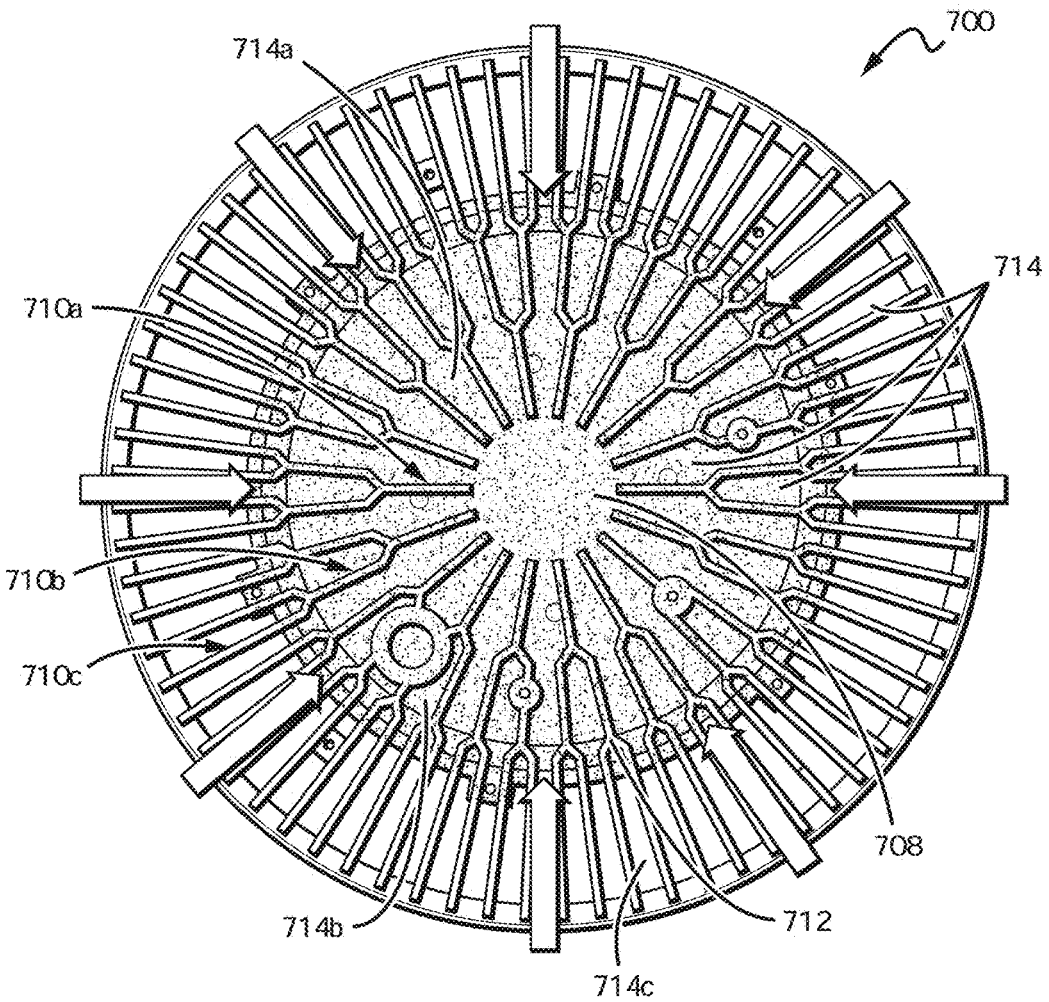

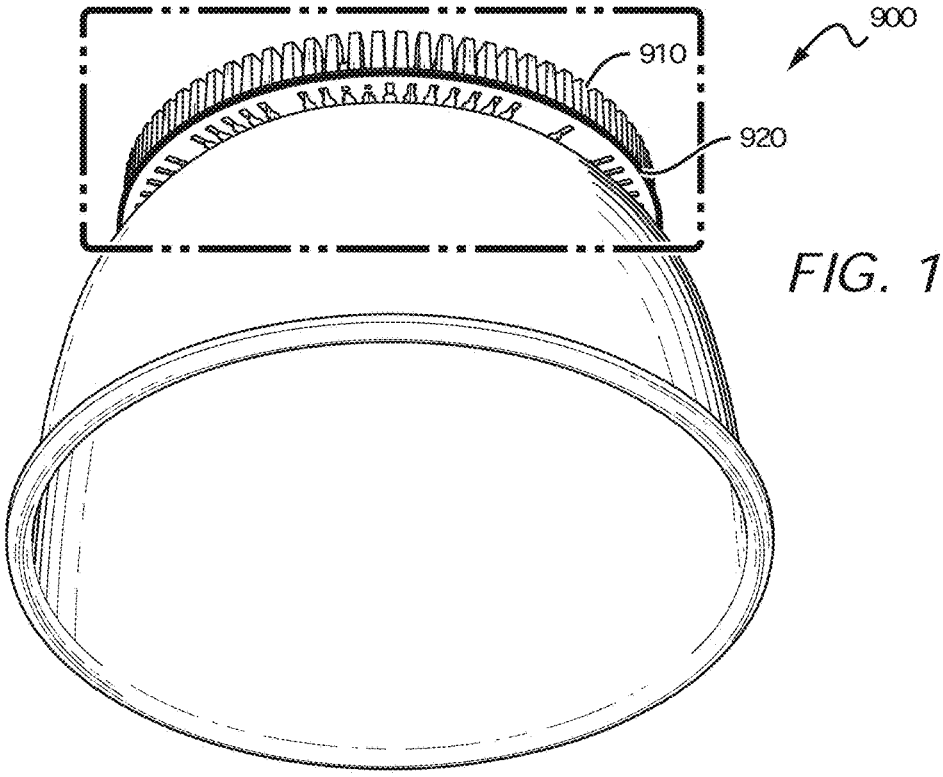
FIG. 15A
FIG. 15B
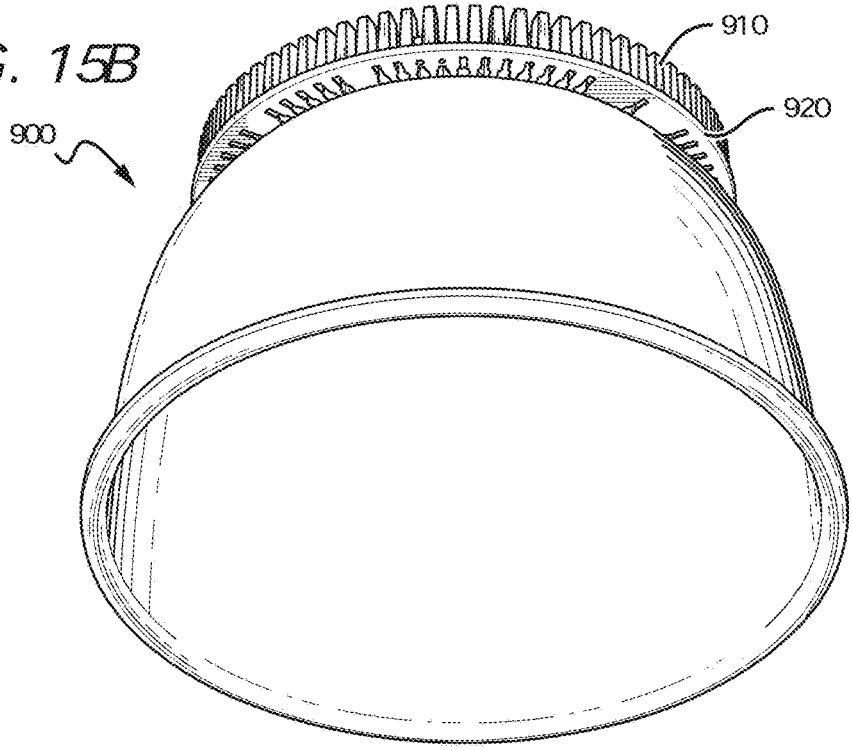

LIGHTING FIXTURE WITH BRANCHING HEAT SINK AND THERMAL PATH SEPARATION

This application is a continuation-in-part of U.S. patent application Ser. No. 13/840,887 to van de Ven et al., filed Mar. 15, 2013 and entitled "Aluminum High Bay Design," which is fully incorporated by reference herein in its entirety.

BACKGROUND OF THE INVENTION

Field of the Invention

The present invention relates generally to lighting fixtures, and in particular to high bay lighting fixtures with one or more enhanced thermal dissipation features.

Description of the Related Art

Industrial or commercial buildings are often illuminated by free-standing lighting fixtures that may be suspended from the ceiling. Certain types of commercial or industrial environments, such as store aisles or warehouses, require lighting that is designed to provide a high degree of luminosity, while still maintaining control over glare. The type of lighting fixture that satisfies these requirements is commonly referred to as bay lighting.

Bay lighting may be classified as high bay or low bay, depending on the height of the lighting fixture, which is usually the distance between the floor of the room seeking to be illuminated and the fixture itself. Naturally, large industrial or commercial buildings with overhead lighting are typically illuminated with high bay lighting fixtures.

In order to sufficiently illuminate this type of environment, a high bay lighting fixture with a high intensity discharge can be used. Yet high intensity lighting fixtures often use light sources such as incandescent, halogen, or fluorescent bulbs, which can have short life spans, difficulty maintaining their intensity, and/or high maintenance costs. The advent of solid state lighting devices with longer life spans and lower power consumption presented a partial solution to these problems.

One example of a solid state lighting device is a light emitting diode (LED). LEDs convert electric energy to light, and generally comprise one or more active layers of semiconductor material sandwiched between oppositely doped layers. When a bias is applied across the doped layers, holes and electrons are injected into the active layer where they recombine to generate light. Light is emitted from the active layer and from all surfaces of the LED.

In comparison to other light sources, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000 to 20,000 hours, but provide less desirable color reproduction. In comparison, LEDs can have lifetimes between 50,000 and 70,000 hours. The increased efficiency and extended lifetime of LEDs is attractive to many lighting suppliers and has resulted in LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

As mentioned above, high bay lighting fixtures usually require a high intensity light source, based on the illumination requirement of their industrial or commercial environment. Yet a problem with most high intensity lighting devices is that they can draw large currents, which in turn generates significant amounts of heat. High intensity LEDs are no exception. The type of high intensity LEDs used in high bay lighting fixtures likewise produce a large amount of heat. Even if an LED is particularly efficient, the amount of heat that it produces can still be substantial. Without an effective way to dissipate heat that is produced, LED light sources can suffer elevated operating temperatures, which can increase their likelihood of failure. Therefore, in order to operate most effectively and reliably, LED light sources need an efficient method to dissipate heat.

One common method that LED high bay lighting fixtures use for heat dissipation is a heat sink. A heat sink is essentially an element that is in thermal contact with a light source, so that it dissipates heat from the light source. Whenever the heat dissipation ability of the basic lighting device is insufficient to control its temperature, a heat sink is desirable. Some common heat sink materials are aluminum alloys, but other materials or combinations of materials with good thermal conductivity and heat dissipation potential will suffice.

Many common LED high bay lighting fixtures include a heat sink that is in thermal contact with the light source. FIG. 1 displays one such example of a typical LED high bay lighting fixture 10. Included in this example are an LED driver housing 12, a heat sink 14, and a spun housing 16. The heat sink 14 can be a large "extrusion/stack fin" heat sink, which can be made of a heat conductive material such as aluminum. Likewise, the spun housing 16 can also be composed of a metal such as aluminum. The large size of the heat sink 14 is typical in order to dissipate the heat from a high intensity light source commonly used in high bay lighting.

FIG. 2 displays another example of a traditional LED high bay lighting fixture 20. In this example, the high bay lighting fixture 20 includes a high intensity discharge ballast 22 and a spun housing 26. Lighting ballasts can refer to any component that is intended to limit current flow through a light source. The ballast 22 displayed in FIG. 2 is a common choice for many high bay lighting fixtures and other high intensity discharge lighting fixtures. As in the previous example, the spun housing 26 is typically made of aluminum.

Typically and as shown in FIGS. 1 and 2, driver electronics are installed directly above an emitter array, meaning that the electronics and emitters share a primary heat dissipation path. Heat from the emitters will rise, often through a heat sink, to the location of the driver electronics. Because the driver electronics are also one of the main heat sources in such a fixture, heat may not dissipate as effectively from the emitters as if there were a thermal dissipation path free of other heat sources.

FIGS. 3A and 3B are a side view and a side thermal imaging of a prior art LED high bay lighting fixture 30 including a housing 36 and a driver housing 32. As can be seen in FIG. 3B, the LED driver housing 32 is a heat source. In a typical prior art fixture, driver electronics can contribute about 10% of the total heat generated by the fixture during operation, although in some fixtures this percentage can be lower or higher. The heat generated by the driver can cause the emitter operating temperature to rise, leading to a loss in intensity and/or efficiency. This fixture is similar in many respects to the LED fixture 10 from FIG. 1. However, in this embodiment the LED driver housing 32 is about three to six feet directly above the light emitting elements (not shown).

This connection can be made using a steel pipe 34, which can also provide electrical connection. While the light emitting elements are the main source of heat within the fixture, the driver electronics also contribute a significant amount to the overall heat generation of the fixture. Separating the light engine from the driver housing 32 in this manner can improve thermal dissipation to a certain extent, but also increases the overall height of the fixture, which may be undesirable.

SUMMARY OF THE INVENTION

Based on the aforementioned issues, there is an increasing demand for options within high bay lighting that can effectively dissipate the heat generated by the light source more effectively.

One embodiment of a lighting fixture according to the present invention can include an array of emitters on a heat sink. The fixture can include a driver box for holding drive electronics to drive the array of emitters. The driver box can be horizontally offset from the array.

Another embodiment of a fixture according to the present invention can include one or more emitters mounted on a heat sink, with the emitters having a primary dissipation path. The fixture can also include a driver box which has a primary dissipation path. The dissipation paths of the emitter (s) and the driver box can be different.

One embodiment of a heat sink according to the present invention can include a plurality of inner level spokes and a plurality of outer level spokes. At least two of the outer level spokes can emanate from each of the inner level spokes.

These and other aspects and advantages of the invention will become apparent to those skilled in the art from the following detailed description and the accompanying drawings, which illustrate by way of example the features of the invention.

BRIEF DESCRIPTION OF THE DRAWINGS

FIGS. 7A-7F are top perspective, bottom perspective, top, front, side, and bottom views, respectively, of another embodiment of a lighting fixture according to the present invention;

FIGS. 8A-8J are top perspective views of other embodiments of lighting fixtures according to the present invention;

FIGS. 9A-9C are top perspective, top, and side views, respectively, of an embodiment of a heat sink according to the present invention;

FIG. 10 is a magnified top view of another embodiment of a heat sink according to the present invention;

FIG. 11 is a partial bottom perspective view of yet another embodiment of a fixture according to the present invention;

FIGS. 12 and 13 are top and top perspective views, respectively, of another embodiment of a heat sink according to the present invention;

FIGS. 15A-15B are bottom perspective views of another embodiment of a fixture according to the present invention.

DETAILED DESCRIPTION OF THE INVENTION

Figure 1:
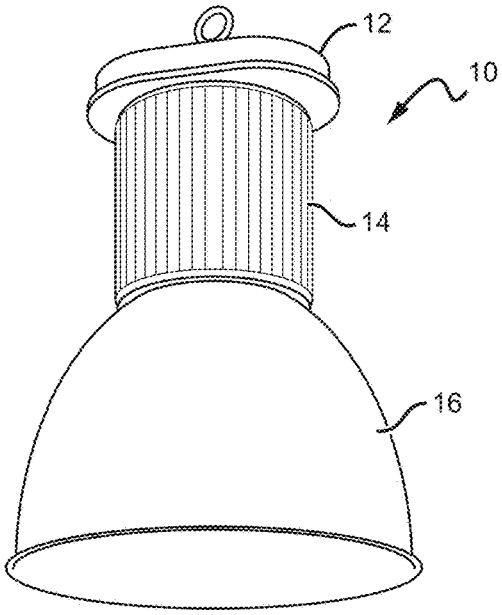
FIG. 1 PRIOR ART
FIG. 1 is a bottom perspective view of a prior art high bay lighting fixture.
Figure 2:
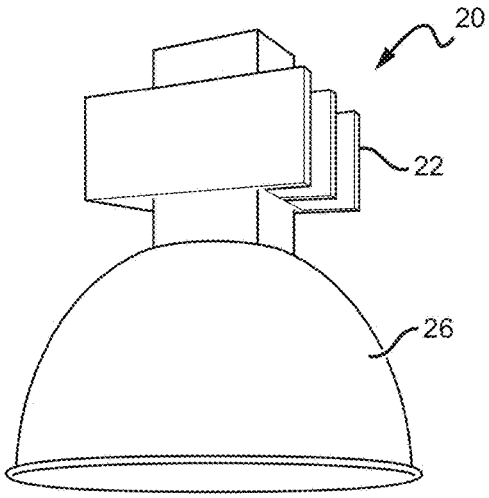
FIG. 2 PRIOR ART
FIG. 2 is a bottom perspective view of another prior art high bay lighting fixture.

Embodiments of the present invention have similarities to embodiments described in commonly assigned utility application U.S. patent application Ser. No. 14/145,355 to Lui et al., entitled "Lighting Fixture with Reflector and Template PCB" and filed concurrently on the same day as the present application. This application is fully incorporated by reference herein in its entirety.

Embodiments of the present invention have similarities to embodiments described in commonly assigned design application U.S. Pat. App. No. 29/478,149 to Lui et al., entitled "Bay Lighting Fixture" and filed concurrently on the same day as the present application. This application is fully incorporated by reference herein in its entirety.

The present invention is directed to different embodiments of lighting fixtures comprising one or more of various improved features which can, among other things, improve the thermal dissipation of the fixture. One of these features can be driver electronics which are horizontally displaced from an emitter and/or emitter arrays. As discussed above, the presence of driver electronics in the thermal dissipation path of emitters can cause decreased functionality, such as a loss of emitter intensity. In one embodiment of the present invention, the driver electronics are moved to an off-center location, such as to the periphery of the heat sink. The driver box(es) containing the driver electronics can be horizontally displaced from the emitters. Heat from the driver box(es) can dissipate into the ambient instead of through the thermal dissipation path used by the emitters, which can lead to lower emitter operating temperatures and, therefore, higher emitter intensity and longer emitter lifespans.

Another feature of some embodiments of the present invention is a heat sink specially designed for improved or enhanced thermal dissipation. The heat sink can include thermally conductive spokes emanating from the heat sink's center. As these spokes move further away from the center of the heat sink, they can branch into multiple spokes. The heat sink can comprise different levels of spokes, such as an original level of 18 spokes, a secondary level of 36 spokes (two each emanating from one of the 18 original level spokes), a tertiary level of 108 spokes (three each emanating from the secondary level spokes), and so on. Other embodiments can have different levels with different numbers of spokes, such as, for example, a tertiary level of 72 spokes (two each emanating from the secondary level spokes). One spoke can branch into two, three, four, or more spokes in a subsequent level, and any number of levels is possible.

In some embodiments of heat sinks according to the present invention, spaces remain between the spokes. Air can access some or all of these spaces, such as air from the bottom side of the heat sink. This can improve convective cooling of the heat sink. Air can pass through the heat sink and toward its center, which is typically the hottest area. This can increase overall thermal dissipation.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing.

Throughout this description, the preferred embodiment and examples illustrated should be considered as exemplars, rather than as limitations on the present invention. As used herein, the term "invention," "device," "method," or "present invention" refers to any one of the embodiments of the invention described herein, and any equivalents. Furthermore, reference to various feature(s) of the "invention," "device," "method," or "present invention" throughout this document does not mean that all claimed embodiments or methods must include the referenced feature(s).

The present invention is described below in regards to certain lamps and/or fixtures having one or multiple LEDs or LED chips or LED packages in different configurations, but it is understood that the present invention can be used for many other lamps having many different configurations. The term "source" can be used as all-encompassing to describe a single light emitter or multiple light emitters. The embodiments below are described with reference to LED or LEDs and/or source or sources, but it is understood that this is meant to encompass LED chips and LED packages as well as other solid state emitters. The components can have different shapes and sizes beyond those shown and different numbers of LEDs can be included. It is also understood that some of the embodiments described below utilize co-planar light sources, but it is understood that non co-planar light sources can also be used. It is also understood that the lamp's LED light source may be comprised of one or multiple LEDs, and in embodiments with more than one LED, the LEDs may have different emission wavelengths. Similarly, some LEDs may have adjacent or contacting phosphor layers or regions, while others may have either adjacent phosphor layers of different composition or no phosphor layer at all.

It is also understood that when an element or feature is referred to as being "on" or "adjacent" to another element or feature, it can be directly on or adjacent the other element or feature or intervening elements or features may also be present. In contrast, when an element is referred to as being "directly on" or extending "directly onto" another element, there are no intervening elements present other than, in some cases, an adhesive. Additionally, it is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present unless stated.

Relative terms such as "outer," "above," "lower," "below," "horizontal," "vertical" and similar terms may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

FIGS. 4A-4F are a top perspective, bottom perspective, top, front, side, and bottom view, respectively, of a lighting fixture 100 according to one embodiment of the present invention. The fixture can include a light engine 102, which can include a heat sink 104, a lens 106, and one or more emitters (not shown) which will be described in detail below. The fixture 100 can also include one or more driver boxes 108, a junction box (or "j-box") 110, and/or a reflector 112.

Figure 5:
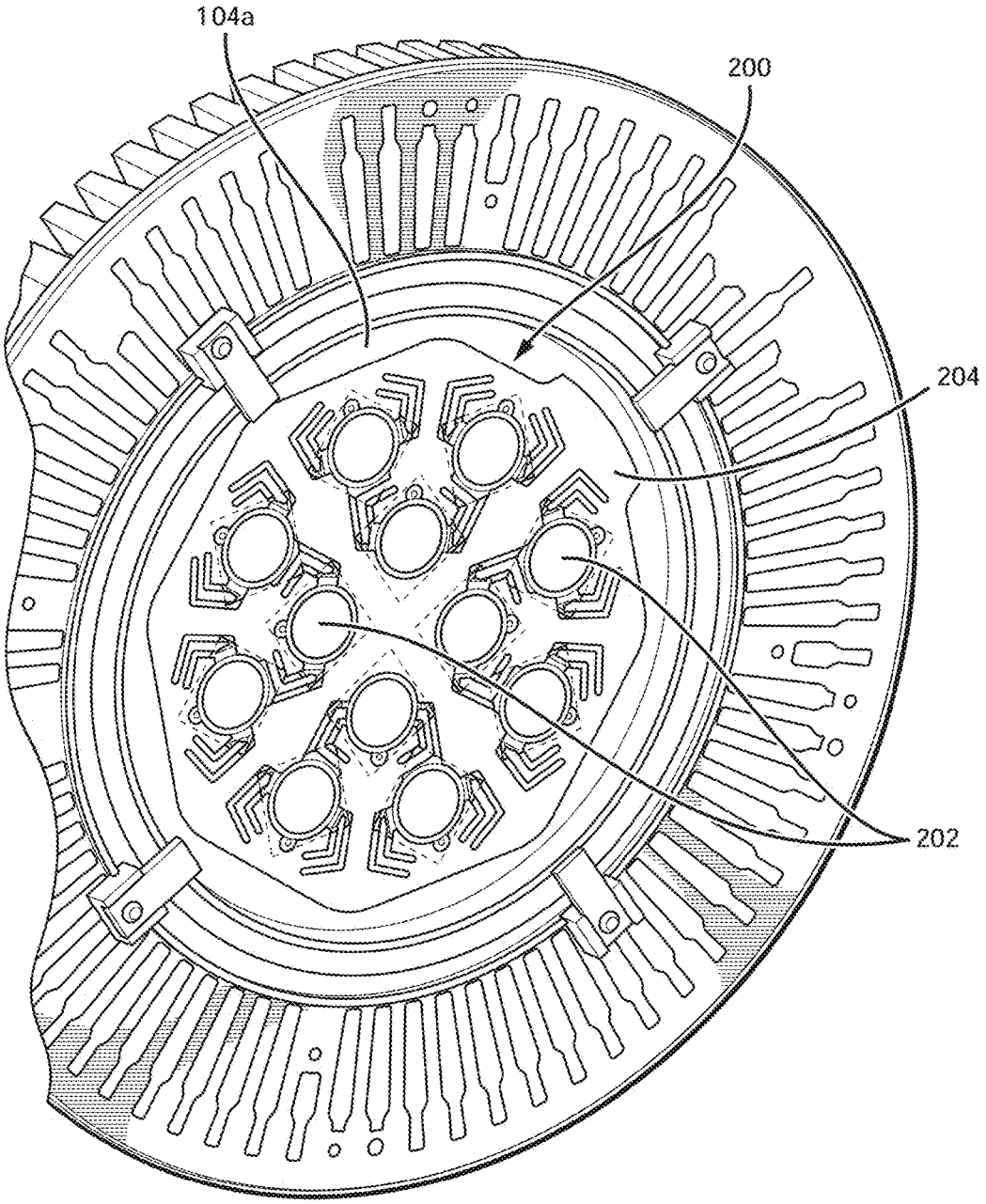
FIG. 5 is a perspective view of an embodiment of an emitter arrangement according to the present invention.
Figure 7C:
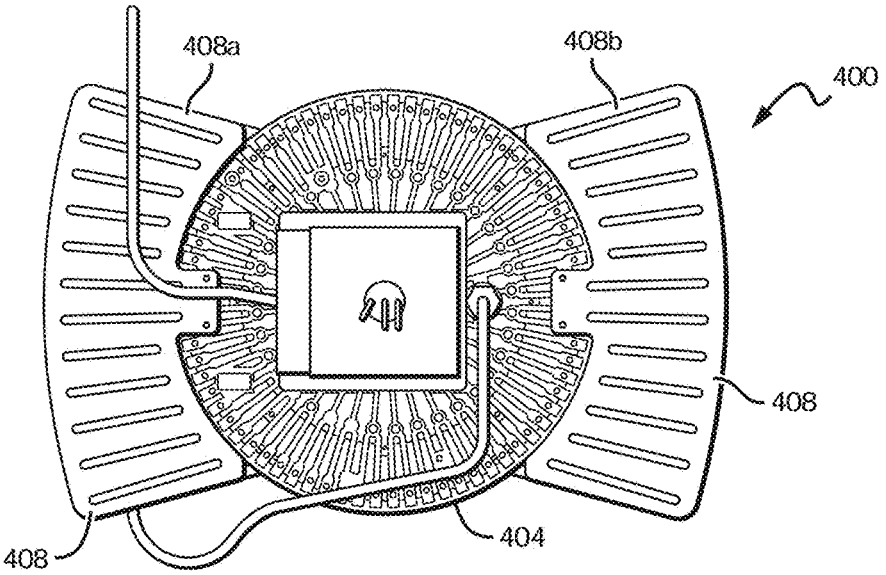
Figure 7E:
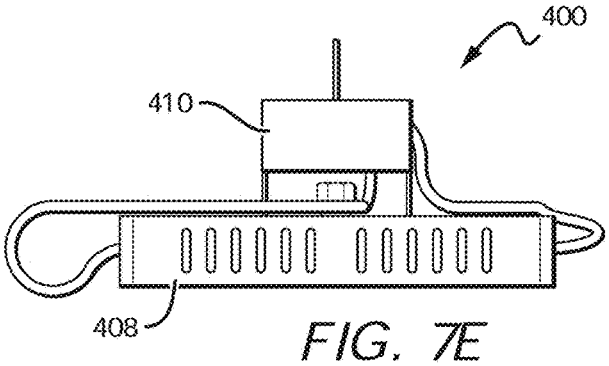
Figure 7F:
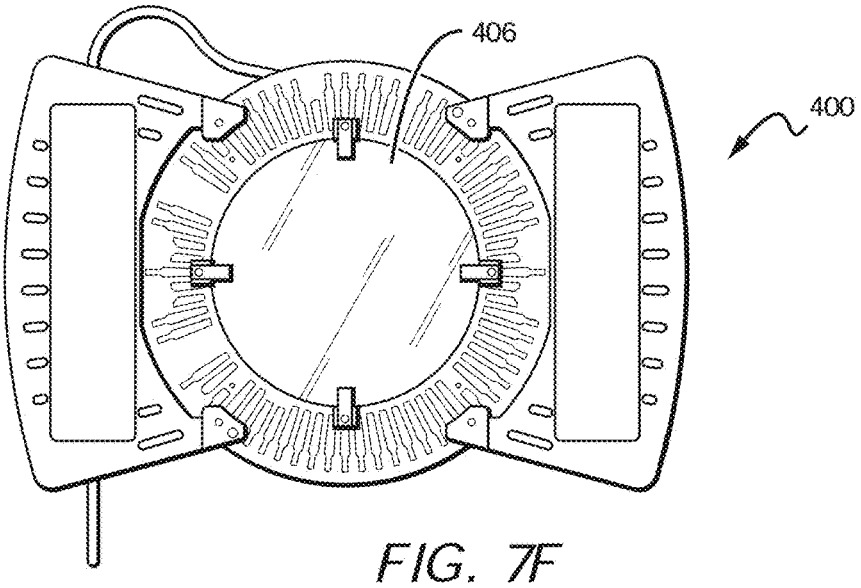
Figure 8A:
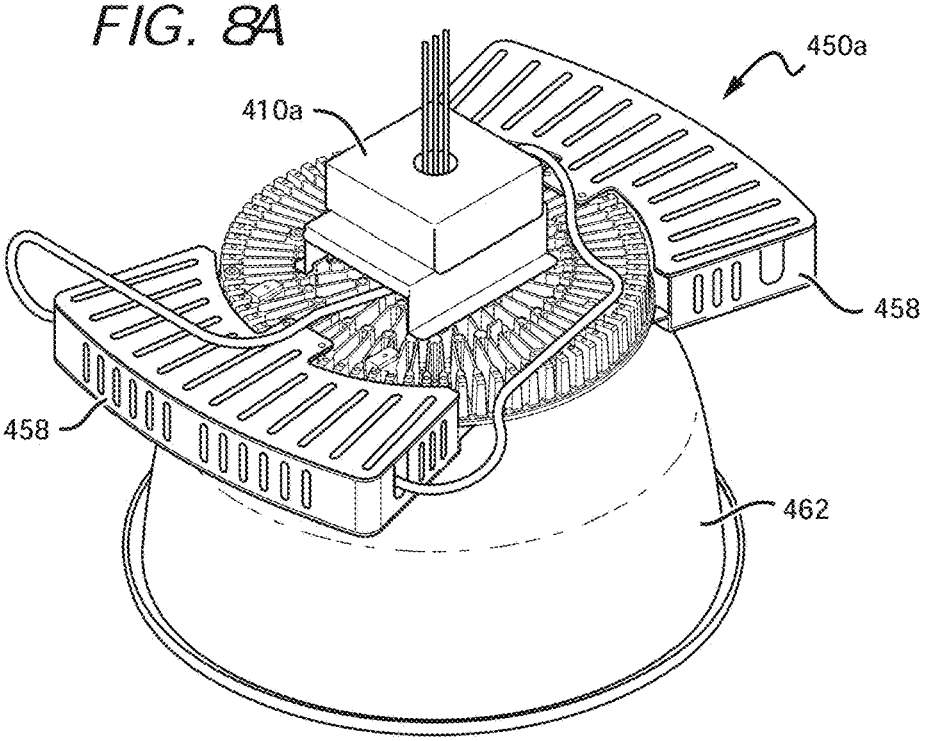
Figure 8B:
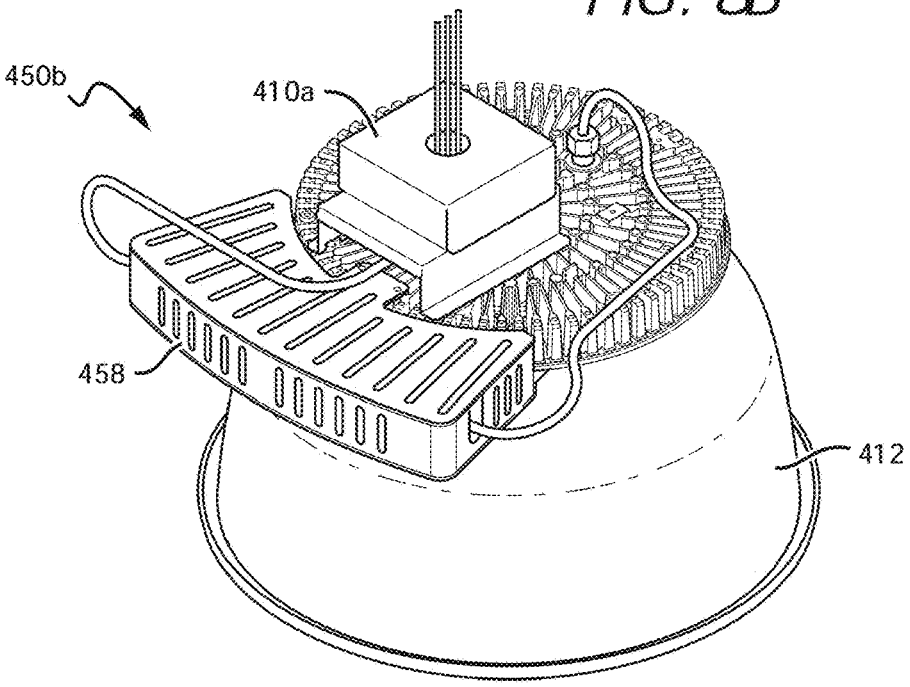
Figure 8C:
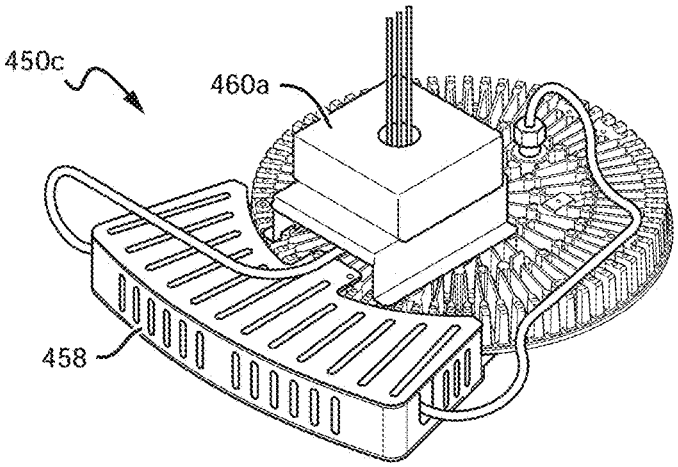
Figure 8D:
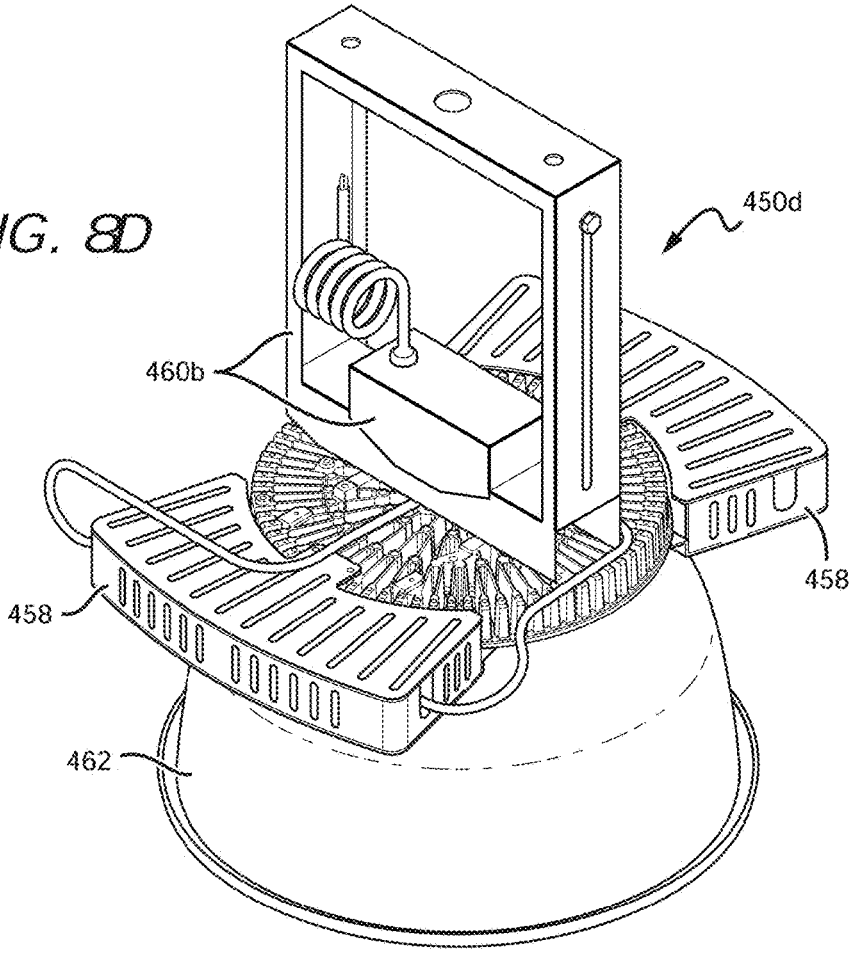

One possible array 200 of emitters 202 which can be used in embodiments of the present invention is shown in FIG. 5. The array 200 can be located on a portion of the heat sink 104 under the lens 106 (if a lens is present). In this specific embodiment, twelve Cree® XLamp® CXA 2530 LED arrays are used for the emitters 202, although fewer or more emitters are possible. Portions of the emitters 202, such as the outer portions, can form an array perimeter. The emitters 202 can be electrically connected to one another by, for example, a template PCB 204 or a conventional PCB. Array arrangements, such as arrangements including the template PCB 204, are described in detail in commonly assigned and concurrently filed U.S. patent application Ser. No. 14/145,355 to Lui et al., entitled "Lighting Fixture with Reflector and Template PCB."

The emitters can be mounted on a heat sink, such as the heat sink 104 and/or the mount area 104*a*. Many different types of emitters can be used in embodiments of the present invention. For example, in the embodiment shown the Cree® XLamp® CXA 2530 LED array can be used for each of the emitters 202. This particular array delivers high lumen output and efficacy. The data sheet of the CXA 2530 is incorporated herein by reference in its entirety. Other Cree® emitters can be used in the present invention, including but not limited to any of the Cree CXA series such as the CXA 1520, CXA 2520, and CXA 3590, MC-E, MK-R, ML-B, ML-C, ML-E, MP-L, MT-G, MT-G2, MX-3, MX-6, XB-D, XM-L, XM-L2, XP-C, XP-E, XP-E2, XP-G, XP-G2, XR-C, XR-E, and XT-E. This list should not be construed as limiting, as many different solid state emitters, emitter arrays, LEDs, and/or LED arrays can be used.

Further, while the emitters 202 can all emit the same color (e.g., white), in other embodiments different color emitters can be used. Further, color mixing optics can be used to efficiently mix the light emitted by these emitters. The use of multicolor arrays in SSL fixtures is discussed in detail in U.S. patent application Ser. No. 13/828,348 to Edmond et al. and entitled "Door Frame Troffer", and U.S. patent application Ser. No. 13/834,605 to Lay et al. and entitled "Indirect Linear Fixture", each of which is commonly assigned with the present application and each of which is fully incorporated by reference herein in its entirety.

In yet other embodiments, the emitters 202 can emit all the same color while a remote phosphor is used to convert at least some source light to a different wavelength, with the fixture emitting a combination of converted and unconverted light. One embodiment emits a combination of blue light from the sources and yellow light from the remote phosphor for a white light combination. Another embodiment emits a combination of blue light from the sources and yellow and red light from phosphor for a warmer white light combination. Some examples of source and remote phosphor configurations and types which can be used in embodiments of the present invention are described in U.S. patent application Ser. No. 13/034,501 to Le et al. and entitled "Solid State Lamp and Bulb", which is fully incorporated by reference herein in its entirety.

The fixture 100 from FIGS. 4A-4F can include emitters arranged in any manner to achieve a desired output. High bay fixtures are typically used in high output applications. For example, fixtures according to the present invention, such as a fixture comprising the array 200 shown in FIG. 5, can achieve an output of approximately 18,000 lumens or more and/or an efficacy of approximately 90 lm/W. In a preferred embodiment, the a fixture according to the present invention can produce an output of approximately 23,000 lumens or more and/or an efficacy of approximately 100 lm/W or more. Specific emitter types and arrangements which can be used in embodiments of the present invention are described in the commonly assigned and concurrently filed application "Lighting Fixture with Reflector and Template PCB" to Lui et al.

Referring back to FIGS. 4A-4F, the specific embodiment shown can include one driver box 108, although other embodiments are possible. The driver box 108 can be made of many different materials, such as thermally conductive materials including but not limited to aluminum. The driver box 108 can house some or all of the drive electronics necessary for proper functioning of an array such as the emitter array 200. Drive electronics and drivers are well-known in the art and will not be described in detail herein. The driver box 108 can be mounted in a number of ways, some of which will be described herein. In the embodiment shown, the driver box can be mounted off-center with relation to the fixture 100, the light engine 102, the heat sink 104, the j-box 110, and/or the reflector 112. In the embodiment shown, the driver box 108 can be placed such that no portion is directly over an emitter, any part of an emitter array, and/or any part of a mount area. The driver box 108 can be mounted to many different elements, including but not limited to the heat sink 104, which may dissipate some of the heat generated by the driver box 108.

The driver box 108 can be horizontally offset from one or more elements, including the array 200, such that the driver box 108 is not centered above the array 200. In the specific case shown, the driver box 108 is mounted to, on, and/or around the periphery or side surface(s) of the heat sink 104, although many different locations are possible. For instance, the driver box 108 could be on a top surface of the heat sink. The driver box can be completely, primarily, substantially, and/or partially horizontally offset from any one or ones of the fixture 100, light engine 102, heat sink 104, mounting area 104*a*, and/or array 200. In some embodiments the driver box 108 does not share a central vertical axis with any one or more of these elements. In some embodiments the driver box 108 is off-center from any one of these elements.

In some embodiments the driver box 108 can be outside the perimeter of the array 200, such that when looking down upon the fixture 200 no portion of the array overlaps any portion of the driver box 108. In some embodiments, the driver box 108 can be primarily outside the perimeter of the array 200 or can be substantially outside the perimeter of the array 200. In some embodiments the driver box 108 can be completely, primarily, substantially, and/or partially outside the mounting area 104*a*. In some embodiments the driver box 108 can be horizontally remote to the array 200 and/or the mounting area 104*a* such that there is one or more intervening elements in a substantially horizontal plane running through both the driver box 108 and the array 200 and/or mounting area 104*a*.

The driver box 108 can have an inner shape that matches the outer shape of the heat sink 104, such as, in the embodiment shown, a circular shape. The driver box 108 can include one or more attachment portions 108*a* which can be on the top surface of the heat sink 104. As will be discussed in detail below, the heat sink 104 can be shaped to define various openings which can allow air to flow vertically through the heat sink. The driver box 108 can block as little open area as possible on the top and/or bottom surfaces of the heat sink 104 in order to allow as much air as possible to flow through these openings. In some embodiments no open areas on the top of the heat sink 104 are blocked by the driver box 108. Features such as fans can be used to increase airflow.

Figure 3A:
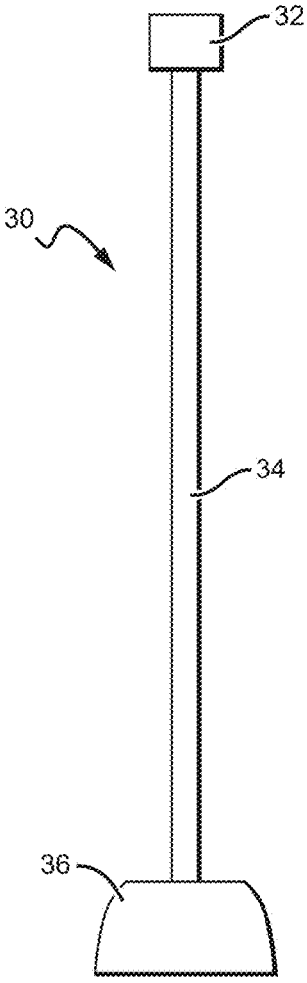
FIG. 3A PRIOR ART
FIGS. 3A and 3B are a side view and a side thermal imaging, respectively, of yet another prior art high bay lighting fixture.
Figure 3B:
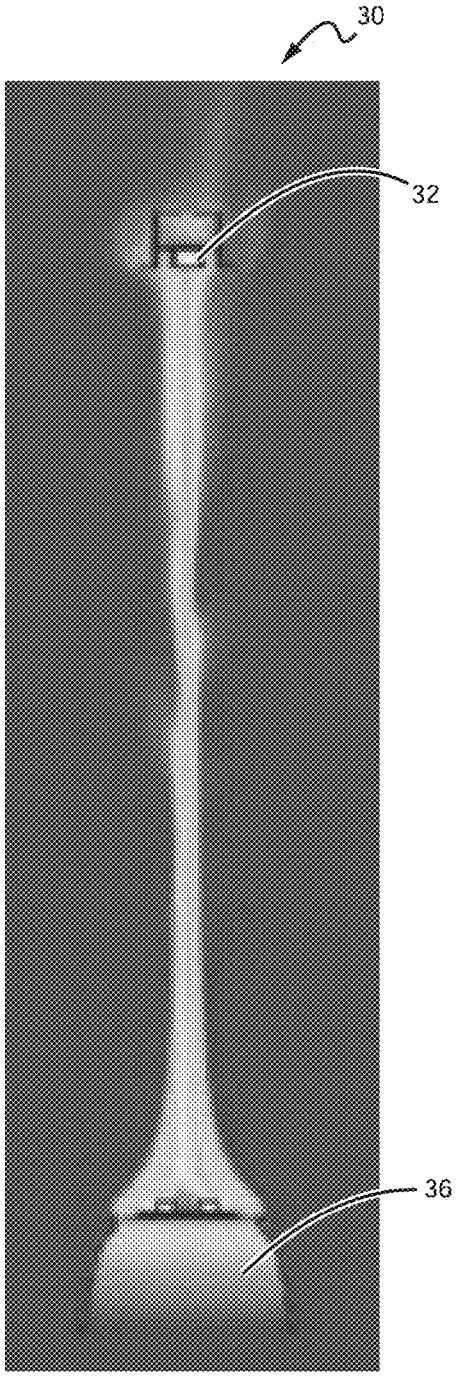
FIG. 3B PRIOR ART
Figure 6:
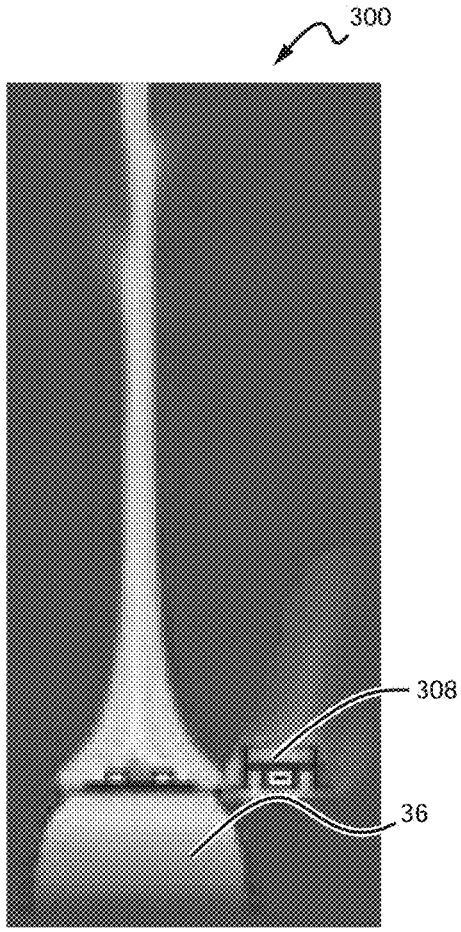
FIG. 6 is a side thermal imaging of another embodiment of a fixture according to the present invention.

By placing a driver box off-center from a light engine and/or emitter array, and/or in any of the positions described above with regard to the present invention, the thermal dissipation paths of an array and a driver box can be separated. In one embodiment the primary thermal dissipation path of the array does not pass through the driver box. FIG. 6 shows a side thermal imaging of a high bay fixture 300 similar to the fixture 100. The fixture 300 and other embodiments of the present invention can have a 1:1 heat source to thermal dissipation path ratio. The high bay fixture 300 can have a driver box 308 attached to the side and/or periphery of a heat sink (not shown for imaging purposes). The driver box 308 can be at approximately the same height as and/or level with a heat sink, emitter array, light engine, or other elements, as opposed to being separated by a large vertical distance as seen in FIGS. 3A and 3B above.

As can be seen, the majority of heat generated by the fixture 300 is generated by an emitter array, such as the emitter array 200, mounted on the heat sink. The thermal path of this heat can pass through a heat sink before being primarily dissipated in a vertical direction which can emanate from the center of the heat sink. One possible reason for this is that heat generally tends to rise. However, the driver electronics in the driver box 308 also generate a noticeable amount of heat, such as around 10% or more of the total heat generated by the fixture 300. As can be seen from FIG. 6, with the driver box 308 mounted to the side of the heat sink holding the emitters, the thermal path of the emitters and the thermal path of the driver box and/or driver electronics can be completely, almost completely, or at least partially separated. For example, while the primary thermal dissipation path of the emitters can pass through a heat sink and emanate vertically from the approximate center of the heat sink, the primary thermal dissipation path of the driver box 308 can be directly into the ambient above the driver box 308. In some embodiments, the heat sink can dissipate substantially only heat from emitters, while substantially all the heat generated within the driver box 308 can pass directly into the ambient. In some embodiments, 80% or more of the heat generated by the driver box 308 passes directly into the ambient; in other embodiments, this number can be 90% or more, or 95% or more. In some embodiments, this heat passes into the ambient in a place remote from where heat from emitters passes into the ambient.

The separation of the thermal dissipation paths achieved by the above embodiments can result in emitters operating at a lower temperature and/or emitting brighter light. This can also result in a longer emitter lifespan. In a model holding all other elements constant, an embodiment of the fixture 30 from FIG. 3B with the driver box 32 mounted six feet above the light engine was compared to an embodiment of the fixture 300 from FIG. 6 with the driver box 308 mounted off-center from the light engine and/or emitters. An array with four inner emitters and eight outer emitters, such as the array 200 from FIG. 5, was used, and adequate contact resistance was assumed. The model was further based on an ambient temperature of 35° C. and an input of 239 W. The results are shown in Table 1, below:

TABLE 1

FIG. 3B v. FIG. 6 Temperature Comparison

| | Driver | | Inner LED | |
|---|---|---|---|---|
| | Min Temp (° C.) | Max Temp (° C.) | Min Temp (° C.) | Max Temp (° C.) |
| FIG. 3B | 72 | 77 | 105 | 113 |
| FIG. 6 | 79 | 83 | 103 | 110 |

As can be seen from Table 1, in an embodiment of the present invention the temperature of the driver box, such as the driver box 308, may be higher than that of a driver box in the prior art vertically separated from the emitters by six feet, such as the driver box 32. However, the temperature of the emitters can be 2-3° C. lower. These differences in temperature can be due to the fact that the thermal dissipation paths are separated. The driver box 308 may in some embodiments be hotter than in the prior art due to the fact that heat from the driver box may not be dissipated using a main thermal dissipation path used by the emitters. However, because the two main heat sources in one embodiment do not share a thermal dissipation path, the influence of the heat from the driver box 308 on the emitters and/or the influence of the heat from the emitters on the driver box 308 can be reduced, minimized, or eliminated. This can result in a device having emitters with a lower operating temperature as shown, for example, in Table 1 above. In some embodiments, the emitters can be free from the thermal influence of any non-emitter structures including driver electronics. In some embodiments, the emitters and the driver electronics may produce some thermal overlap but can have different primary thermal dissipation paths. In some embodiments these paths are completely separate.

Referring back to FIGS. 4A-4F, the j-box 110, which can house wiring, can also serve as a mounting mechanism for the fixture 100. Alternatively the j-box 110 and mounting mechanism can be separate elements. In the embodiment shown, the j-box 110 can be mounted off-center with relation to the fixture 100, the light engine 102, the heat sink 104, the j-box 110, and/or the reflector 112. If the j-box 110 is to serve as a mounting mechanism, such as to a ceiling, this mounting location can serve to balance the weight of the fixture 100 so that the fixture hangs evenly and projects light in an emission pattern normal to the ground. This positioning can have additional benefits. For example, the hottest area of a heat sink may be the area directly above the emitters. By not placing anything directly above the emitters, heat may dissipate from this point more efficiently, which can allow for cooler operation of the emitters. Another potential benefit is that the j-box can be exposed to less heat than if it were placed directly above the emitters, which can increase its lifespan.

FIGS. 7A-7F show another embodiment of a light fixture 400 similar in many respects to the light fixture 100 from FIGS. 4A-4F. The light fixture 400 can include a light engine 402 which can itself include a heat sink 404 and a lens 406, all of which can be similar to or the same as the corresponding elements in FIGS. 4A-4F. Like the fixture 100, the fixture 400 can optionally include a reflector. The fixture 400 can also include one or more driver boxes 408 and one or more j-boxes 410. In the embodiment shown, the fixture 400 can include two driver boxes 408. The two driver boxes 108 can be attached to the heat sink 404 in a manner similar to or the same as the driver box 108 to the heat sink 104 from FIGS. 4A-4F. The drive electronics can be split between the two driver boxes 408*a*,408*b*. In one such embodiment, the driver boxes 408*a*,408*b* can individually be smaller than the driver box 108, since each can contain fewer electronics. Alternatively, all of the electronics can be contained within one of the driver boxes, such as the driver box 408*a*, while the other driver box(es), such as the driver box 408*b*, can be a dummy driver box that serves to balance the weight of the fixture 400 while not containing drive electronics. The driver boxes 408 can be symmetrically placed and/or be opposite one another so as to balance the weight of the fixture 400. Alternatively, the placement of the driver boxes 108 can be unsymmetrical. In one such embodiment, this can allow for an off-center placement of the j-box 410, which can have benefits as previously described. In an embodiment with two driver boxes each containing electronics, the fixture 400 can include three main heat sources: the driver box 408*a*, the driver box 408*b*, and the emitter array (not shown). Each of these heat sources can have a thermal dissipation path separate from the other two, which can maintain the 1:1 heat source to dissipation path ratio. In an embodiment with one operational driver box and one dummy driver box, the fixture can include two main heat sources: a driver box and an emitter array. Each of these sources can also have a separate thermal dissipation path separate from one another.

Many other embodiments of fixtures according to the present invention are possible. For instance, FIGS. 8A-8J show various fixtures 450*a-j*, respectively, including one or two driver boxes 458 and one of three versions of a j-box/mount 460*a*,460*b*,460*c*. Some of these embodiments also include a reflector 462 Any of the j-box/mounts 460*a*, 460*b*,460*c* can be substituted into any embodiment described herein. In the embodiments shown, the j-box 460*a*/460*b*/460*c* can be centered in embodiments comprising two driver boxes 458, and can be off-center in embodiments comprising a single driver box 458, although many different embodiments are possible as described herein.

While the above embodiments shown in FIGS. 4A-4F, 7A-7F, and 8A-8J show one and two driver boxes, respectively, many different symmetrical and unsymmetrical embodiments are envisioned. For example, one embodiment of a fixture according to the present invention can include three driver boxes evenly spaced, such as evenly spaced about the periphery of a heat sink. Alternatively, the three driver boxes could be asymmetrically placed, such as at three of the four quadrants of a heat sink. The weight of such a fixture could then be balanced by placing the j-box off-center. Another alternative involves the use of multiple j-boxes. For instance, in an embodiment where the driver boxes are balanced, two off-center j-boxes that balance one another could be used. Many different iterations of driver box arrangements, j-box arrangements, and combinations of the two are possible given the above disclosure in combination with the knowledge of one skilled in the art, and thus the present disclosure is not limited to the specific embodiments described above.

Figure 9B:
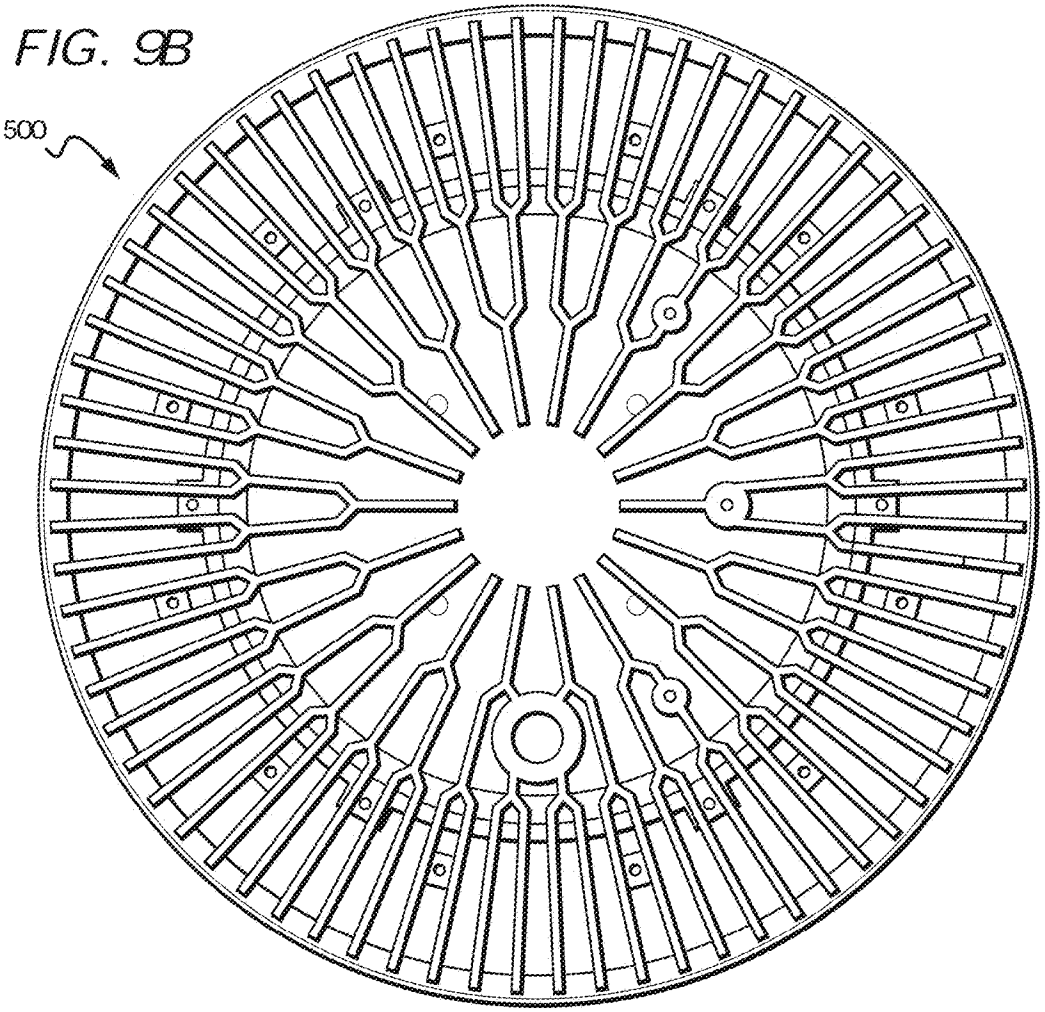
Figure 9C:
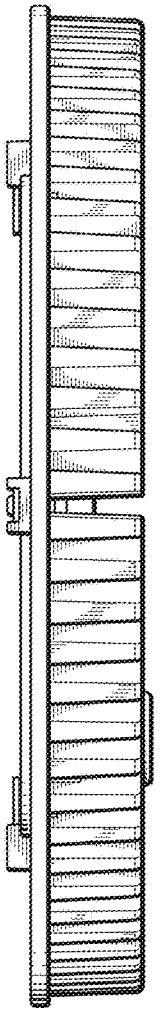

FIGS. 9A-9C show top perspective, top, and side views, respectively, of a heat sink 500 according to the present invention. The heat sink 500 can be used in any fixture including but not limited to fixtures according to the present invention, such as the fixture 100 or the fixture 400. The heat sink 500 can include spokes 501. The spokes 501 can emanate from a central point, such as the center of the heat sink 500. While the embodiment shown includes a center portion 508 devoid of spokes, the spokes 501 can meet and/or connect in the middle in other embodiments. The spokes 501 can branch as they move outward from the center of the heat sink 500. For example, in the embodiment shown the heat sink 500 includes an inner or first level 510*a* of spokes 502, an intermediate or second level 510*b* of spokes 504, and an outer or third level 510*c* of spokes 506. Other embodiments of the heat sink 500 can include only inner and outer levels, or can include four or more levels. In the embodiment shown the heat sink 500 can include a safety ring 520 which will be discussed in detail below, although such a ring is optional. Other embodiments do not include a safety ring 520.

Many different variations of the heat sink 500 are possible. While the spokes 501 can be planar, in other embodiments the spokes 501 are not planar and/or are tilted either symmetrically or asymmetrically. While the spokes 501 shown branch symmetrically, in other embodiments the spokes can branch asymmetrically. The spokes 501 can be rectangular, or can have many different cross-sections. The cross-sections need not be constant, as described in detail below. Many different embodiments are possible.

The heat sink 500 can at least partially comprise a thermally conductive material, and many different thermally conductive materials can be used including different metals such as copper or aluminum, or metal alloys. Copper can have a thermal conductivity of up to 400 W/m-k or more. In some embodiments the heat sink can comprise high purity aluminum that can have a thermal conductivity at room temperature of approximately 210 W/m-k. In other embodiments the heat sink structure can comprise die cast aluminum having a thermal conductivity of approximately 200 W/m-k. The heat sink structure 500 can also comprise other heat dissipation features such as heat fins that increase the surface area of the heat sink to facilitate more efficient dissipation into the ambient. In some embodiments, the spokes 501 can be made of material with higher thermal conductivity than the remainder of the heat sink. In still other embodiments, the heat sink can comprise active cooling elements, such as fans, to further increase convective thermal dissipation. Some heat dissipation arrangements and structures are described in parent application U.S. patent application Ser. No. 13/840,887 to van de Ven et al.

In the embodiment shown, the inner level 510*a* can be said to have a branching factor of two, meaning that each spoke 502 splits into two spokes 504 in the intermediate level 510*b* and/or upon reaching a certain distance from the center of the heat sink 500. Two spokes 504 can emanate and/or directly emanate from a respective first level spoke 502. The second level 510*b* can also be said to have a branching level of two, since each spoke 504 splits into two spokes 506 in the third level 510*c* and/or upon reaching a certain distance from the center of the heat sink 500. These third level spokes emanate and/or directly emanate from their respective second level spoke, and emanate and/or indirectly emanate from their respective first level spoke.

The junctions 512 between spokes of successive levels can take many different forms. For example, a junction such as the junction 512*a* can comprise a solid or hollow cylinder which can connect one spoke to two spokes branching therefrom. In another embodiment, the junction can be a Y-shape, such as the junction 512*b*, or take many other shapes, such as a U-shape or V-shape for example. In yet another embodiment, each of the spokes from one level, such as the inner level 510*a*, can connect to a ring, such as the ring's inner wall, which serves as a junction between levels. The spokes of the next successive level can also connect to this ring, such as to the ring's outer wall.

The number of spokes 502 in each level and in total can vary based on many factors, one of which can be the amount of physical space available. This calculation can take into account the amount of surface area desired for dissipation as well as the amount of space desired to be left open to allow for convective cooling, which will be discussed in detail below. In the embodiment shown, the heat sink 500 can include 18 inner spokes 502, 36 intermediary spokes 502, and 72 outer spokes 502. Many different embodiments are possible, including fewer or more spokes in any of the levels 510*a*,510*b*,510*c*. Some embodiments of heat sinks according to the present invention have 8 or more inner spokes and/or 32 or more outer spokes, such as one embodiment with 32 outer spokes and another embodiment with 48 outer spokes (e.g., if the branching factor of an intermediary level is 2 and of an outer level is 3).

Spokes used in heat sinks according to the present invention can operate similarly to heat fins. The use of different types of heat fins has been described, for example, in commonly assigned U.S. patent application Ser. No. 13/358,901 to Progl and entitled "Lamp Structure with Remote LED Light Source", and commonly assigned U.S. patent application Ser. No. 13/441,567 to Kinnune et al and entitled "LED Light Fixture with Inter-Fin Air-Flow Interrupters", each of which is fully incorporated by reference herein in its entirety. Generally speaking, increasing the surface area of a heat sink such as the heat sink 500 can facilitate higher and/or more efficient dissipation of heat into the ambient. Again generally speaking, anytime one of the spokes 502 splits into two spokes 502, the surface area is doubled or almost doubled. Thus, more heat can be dissipated.

As a spoke 502 moves away from the center of the heat sink 500, the physical distance between adjacent spokes 502 can grow (as opposed to an angular distance in degrees, which would stay constant other than for the branching described herein). The branching of the spokes 502 can take advantage of this space by filling it with more spokes 504, which can add extra heat dissipating surface area and/or increase the overall thermal dissipation of the heat sink 500. Other embodiments where the physical distance between spokes stays the same are possible.

While the heat sink 500 has three levels 510*a*,510*b*,510*c*, and a branching factor for both the inner and middle levels 510*a*,510*b* of two, many other embodiments are possible. Any combination of the number of levels and branching factors is possible. Further, the same number of levels and/or the same branching factor need not apply to an entire heat sink. For instance, a left half of a heat sink can have four levels while a right side has five levels. In another instance, adjacent spokes can have alternating branching factors which can remain constant or change as the spokes move to outer levels. Many different embodiments are possible. While the embodiments specifically shown and described herein include levels with branching factors of 2 or over, branching factors equal to or under 1 are also possible. For instance, two or more spokes in an inner level can rejoin into fewer spokes in a subsequent level in order to encourage convective thermal dissipation, which will be discussed in detail below.

The heat sink 500 can include various openings or spaces, such as the spaces 514 which can allow for airflow over the spokes and/or between the bottom and top of the heat sink 500. These openings will be discussed in more detail below. In some embodiments, such as that shown in FIG. 9A, only a portion of the heat sink includes these openings, such as the third level 510*c*, although in other embodiments more or all of the heat sink can include these openings. Other portions of the heat sink, such as the inner portion, can form a spoke floor 517. The spoke floor can increase conductive thermal dissipation away from the center of the heat sink 508. The spoke floor 517 can in some embodiments be opposite the mount area of a fixture, such as the mount area 104*a* in FIG. 5. Some heat sinks according to the present invention do not include openings such as the openings 516, and instead include a spoke floor which can extend to the edge of the outermost level (such as the level 510*c*).

Generally speaking, the center of the heat sink 500 can be hotter than other portions. This can be because arrays mounted on heat sinks in fixtures such as high bay fixtures are mounted in the center of the bottomside of the heat sink, as shown and described above and in application U.S. patent application Ser. No. 14/145,355 to Lui et al. and entitled "Lighting Fixture with Reflector and Template PCB". FIG. 10 shows a magnified view of a portion of the heat sink 500. As shown by the arrows, the inner spokes 502 (as shown in FIG. 9A) can conduct heat outwards and away from the center of the heat sink 500, thereby dissipating heat outward from the hottest portion of the heat sink 500. One factor in determining the amount of heat conducted by the spokes 502 away from the center of the heat sink 500 can be the cross-sectional area through which heat can be conducted. As shown by the arrows, heat can begin dissipating from the center of the heat sink 500 through one of the inner level spokes such as the spoke 502*a*. That same amount of heat can then be split, such as split equally, between the intermediate spokes 504*a*,504*b*, and again split, such as split equally, between the outer spokes 506*a*,506*b*,506*c*,506*d*.

Each successive level 510 of spokes can have spokes with the same cross-sectional area as spokes of the previous level. Alternatively, the spokes of successive levels 510 can have smaller or larger cross-sectional area. In one embodiment, the cross-sectional area of each of the spokes 502 grows as the spoke moves further away from the center of the heat sink 500 until eventually reaching another branching point such as a junction 512. In one such embodiment, one spoke can branch into multiple spokes cumulatively having approximately equal or greater cross-sectional area than the original spoke. In another embodiment, one spoke can branch into multiple spokes each having approximately equal cross-sectional area to the original spoke. Many different embodiments are possible. In one embodiment, the spokes do not branch, but instead grow in cross-sectional area as they move further from the center of the heat sink.

Figure 4A:
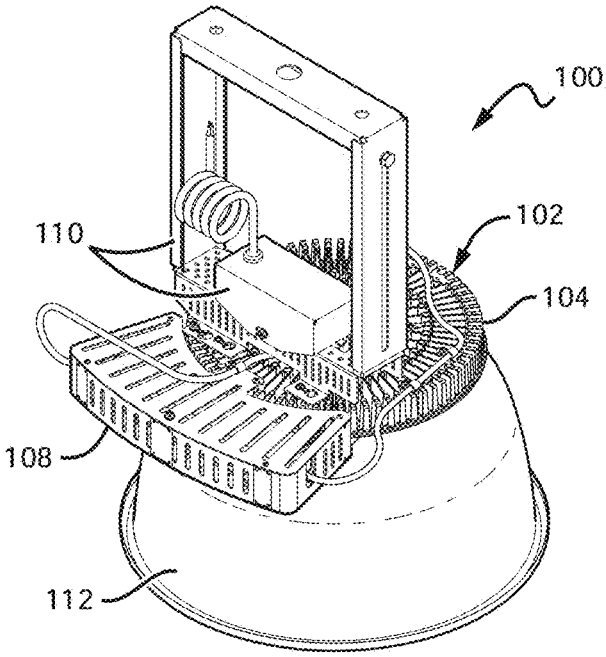
FIGS. 4A-4F are top perspective, bottom perspective, top, front, side, and bottom views, respectively, of an embodiment of a lighting fixture according to the present invention.
Figure 4B:
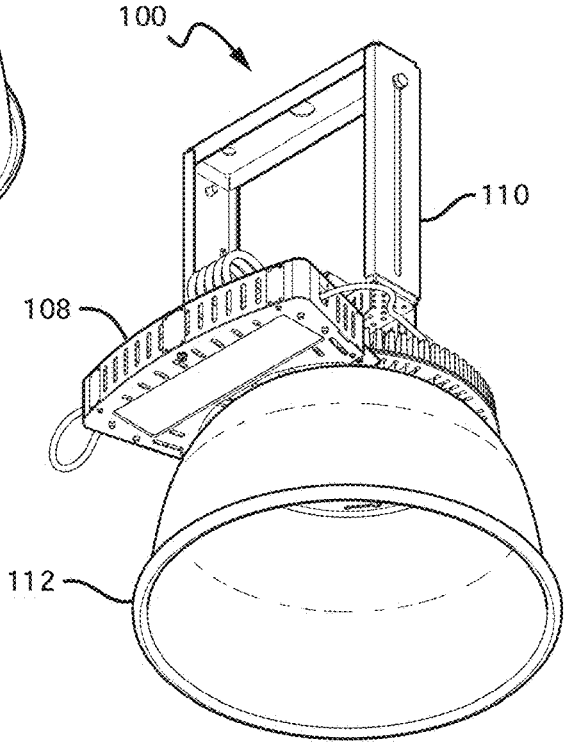
Figure 4C:
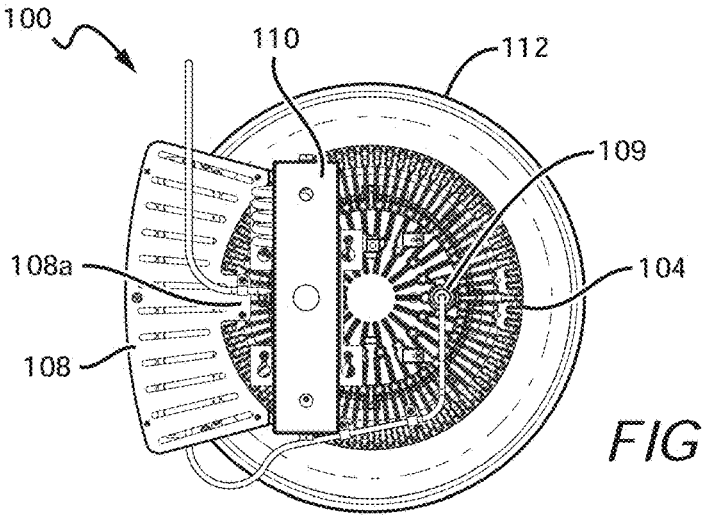
Figure 4D:
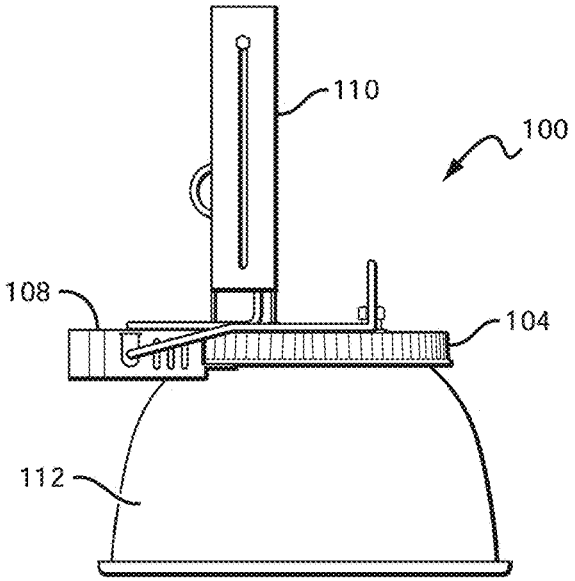
Figure 4E:
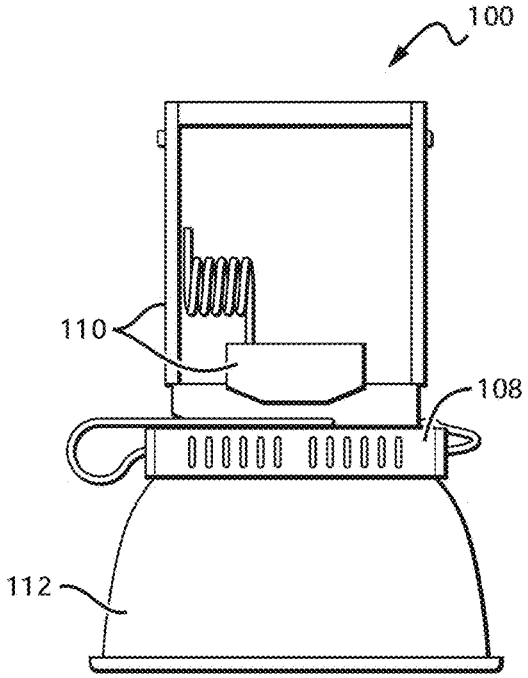
Figure 4F:
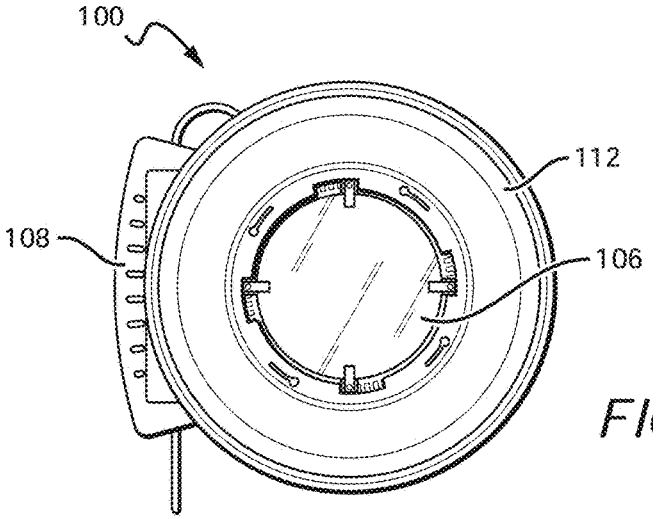

The heat sink 500 can also include a through-hole 509. This through-hole can provide a conduit for providing electrical connection and/or a connection between driver electronics and emitters and/or PCB. For example, as best seen in FIG. 4C discussed above, a through-hole can serve as part of a connection point 109 between a driver box 108 and a PCB with emitters mounted thereon (not shown). This is only one manner in which a connection between elements can be provided, as many other embodiments are possible.

Figure 13:
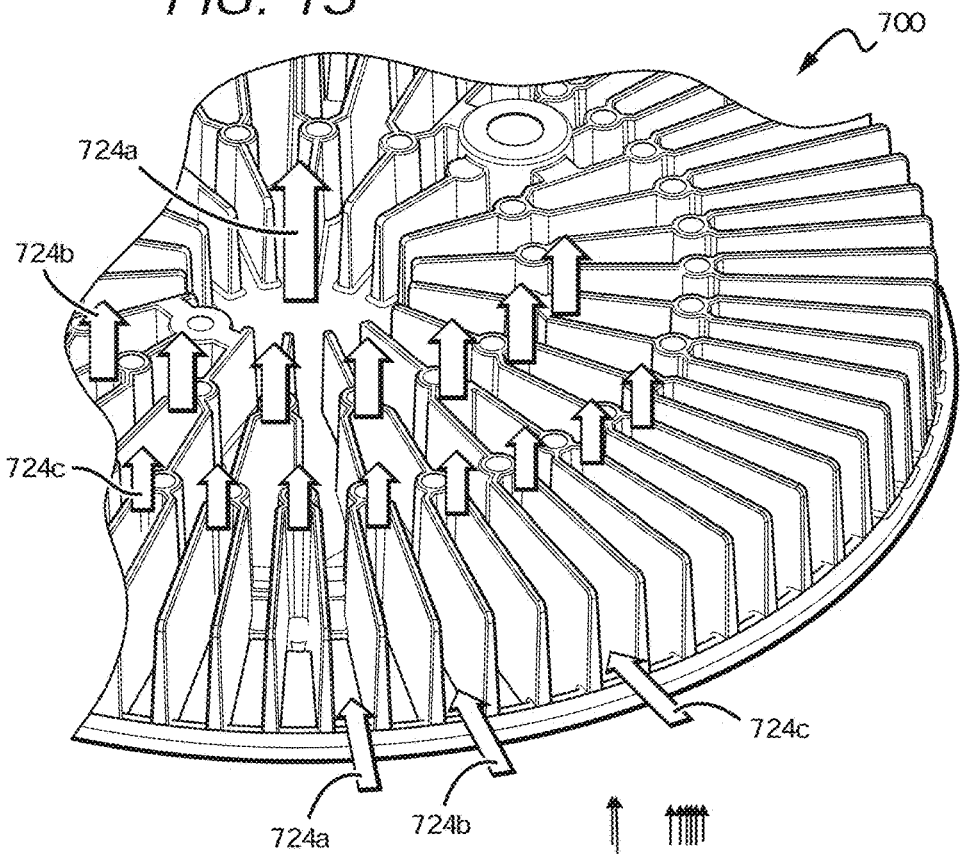

FIG. 11 shows a bottom perspective view of a fixture 600 according to the present invention which can include a heat sink 700. FIGS. 12 and 13 show a top and a top perspective view, respectively, of the heat sink 700. The heat sink 700 can be the same as or similar to the heat sink 500. Heat sinks according to the present invention, such as the heat sinks 500,700, can include spaces between spokes. For example, as best seen in FIG. 12, the heat sink 700 can include spaces 714 between spokes 701. In some embodiments, the spaces 714 can be accessed by outside air, which can be cooler, through various openings. This can increase convective cooling, such as by encouraging air flow past the spokes 701.

As best seen in FIG. 11, the heat sink 700 can include bottom openings 716 and/or side openings 718. In embodiments without a safety ring like the safety ring 720, the openings 716,718 can be connected and/or form one large opening, which can increase convective cooling even further. In such embodiments, the outer portions of the spokes 701 may not be connected. As shown by the arrows, cool air can enter the spaces 714 between spokes 701 from multiple directions. Cool air can enter the bottom openings 716, and/or can enter the side openings 718 to access the spaces 714. When the spaces include openings to the ambient beneath and over the heat sink, the spaces can serve as airways from the bottom surface of the heat sink to the top surface. The intake of cool air from one or more directions, for example as shown in FIG. 11, can increase convective cooling of the fixture 600 and/or heat sink 700.

FIG. 12 shows a top view of one embodiment of the heat sink 700. As shown by the arrows, cool air that enters the spaces 716 and/or the spaces 718 (seen in FIG. 11) can be drawn toward the center 708 of the heat sink 700, and/or can be drawn toward the hottest part of the heat sink 700 as represented by the darker area. This cool air can cool portions of the heat sink 700 as it passes over them through convection.

The air being drawn toward the center 708 of the heat sink 700 can exit the top of the heat sink 700 at various points, as shown by FIGS. 12 and 13. This can be due to the branching design of the spokes 701. As air drawn into the spaces 714 is drawn toward the center 708, it may encounter junctions 712 which can force the air to rise as shown by the arrows. In the embodiment of the heat sink 700 shown, where the inner and middle levels 710*a*,710*b* have branching factors of two, some of the air drawn toward the center 708 can be forced out the top of the heat sink 700 at the junctions 712 between the second and third levels 710*b*, 710*c*, as shown by the arrows 724*c*. This can be because the spaces 714*c*, representing about half of the total spaces, may not reach the middle level 710*b*. Some of the remaining air can be forced out the top of the heat sink 700 at the junctions 712 between the first and second levels 710*a*,710*b*, as shown by the arrows 724*b*. This can be because the spaces 714*b*, representing an additional 25% of the total spaces, may not reach the inner level 710*a*. The remaining air can reach and/or convectively cool the center 708, and rise out of the heat sink 700 approximately at the center 708 as shown by the arrows 724*a*. This can be because the spaces 714*a*, representing the remaining 25% of the total spaces, can reach the inner level 710*a* and/or the center 708. It is understood that this concept can be applied to heat sinks with different branching factors. For example, air in about ⅔ of the spaces can be forced out by a junction upon attempting to enter a level with a branching factor of 3.

Air exiting a heat sink, such as the heat sink 700, at different points can have different velocities, and thus the percentage of air does not necessarily directly correlate to the area of the openings in each successive level. For example, air nearer the center 708 of the heat sink 700 can have a higher velocity and/or buoyancy, meaning that in such an embodiment while only one in four spaces reaches the center 708, the percentage of air reaching the center 708 can be above 25%.

Figure 14:
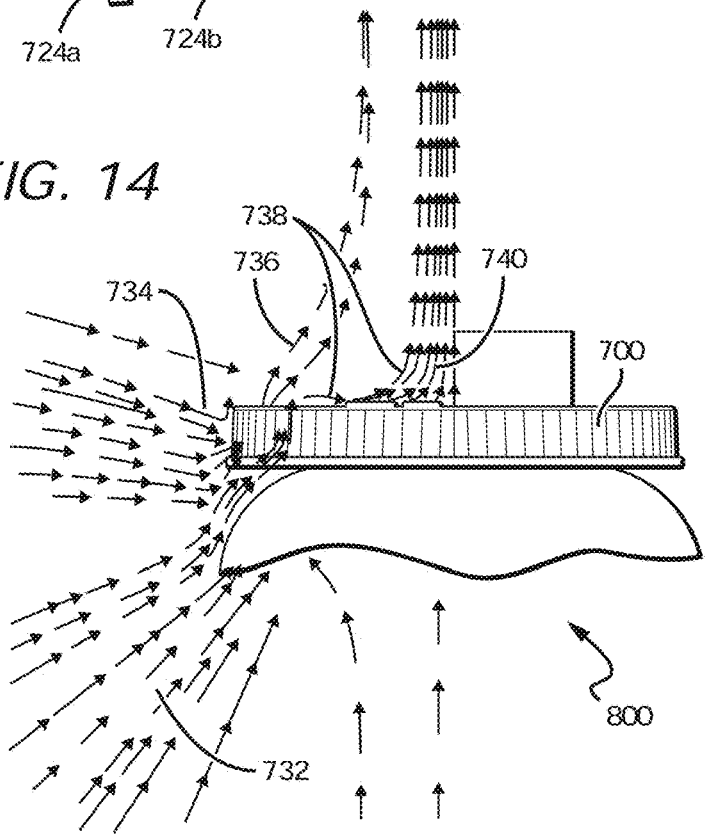
FIG. 14 is a thermal side view of another embodiment of a fixture according the present invention.

FIG. 14 is a side view of a fixture 800 which can include a heat sink such as the heat sink 700. FIG. 14 shows thermal images of airflow in the fixture 800. The cool airflow 732 approaches the fixture 800 and the heat sink 700 from the bottomside before eventually entering the heat sink 700. Portions of the airflow 732 can enter the bottom openings 716 described above with regards to FIGS. 11-13. Some of this airflow 732 may pass substantially vertically through the heat sink 700 and/or the spaces 714 and become part or all of the airflow 736. In this way the spaces 714 can serve as airways from the bottom of the heat sink 700 to the top. As can be seen from the thermal images, the airflow 736 can be hotter than the airflow 732, indicating that at least some heat from the heat sink 700 has been dissipated. Other portions of the airflow 732 may instead travel substantially horizontally through the heat sink 700 and/or spaces 714 in a manner similar to the airflow 734, which will be described below.

The airflow 734 can enter the heat sink 700 and/or the spaces 714, such as through the side openings 718 and/or from above the heat sink 700. Some of the airflow 734 can exit the top surface of the heat sink 700 as part of the airflow 736, described above. This air may have entered a space 714*c*, which may not pass into the intermediate or inner levels 710*b*,710*a* before encountering a junction 712. Another portion of the airflow 736, such as the portion that enters spaces 714*b*,714*a*, may pass further into the heat sink 700. Airflow in the spaces 714*b* may be forced out the top of the heat sink 700 and become part of the airflow 738 upon, for example, encountering a junction that can prevent it from passing into the inner level 710*a*. As can be seen from the thermal imaging, the airflow 738 is hotter than the airflow 736, indicating that 1) more heat from the heat sink 700 was dissipated into the airflow as the air traveled further within the heat sink, and/or 2) more central portions of the heat sink 700 give off more heat than outer portions. A combination of these two factors can occur.

Finally, some airflow may reach the center portion 708 of the heat sink 700, as best shown in FIG. 12. This portion can exit the top of the heat sink in the airflow 740, which can be approximately at the center of the heat sink 700. The airflow 740 can be hotter than the airflows 736,738 for one or more of the reasons discussed above with regard to the airflow 736.

Heat sinks according to the present invention can comprise a safety ring such as the safety ring 520 shown above in FIG. 9A. For example, FIGS. 15A and 15B show bottom perspective views of a fixture 900 with a heat sink 910 comprising a safety ring 920. The safety ring 920 is highlighted in FIG. 15A for identification purposes. The safety ring 920 can connect the outer and/or lower edges of spokes such as the spokes in heat sinks according to the present invention, which can increase mechanical strength of the heat sink and/or increase conductive thermal dissipation. While in the embodiment shown the safety ring 920 connects the bottom outer corners of the spokes of the heat sink 910, many other embodiments are possible. For example, in one embodiment the safety ring 920 can connect the entire height of the outer surfaces of the spokes such that no side openings (such as the side openings 718 from FIG. 11) are present. The safety ring 920 can also simplify fabrication. If the heat sink 920 is die-cast, molten aluminum can attach to the safety ring 920.

In some embodiments, one or more of the outer level spokes can extend past the safety ring (if present) or otherwise stick out from the other spokes and/or remainder of the heat sink. These spokes can serve as an attachment means for, for example, a driver box such as the driver box 108 from FIGS. 4A-4F.

Embodiments of the present invention can be used to retrofit prior art bay fixtures. For example, driver boxes of a prior art arrangement could be retrofitted with one of the driver box arrangements described above. The above disclosure describes manners of heat dissipation devices and techniques, while the disclosure of application U.S. patent application Ser. No. 14/145,355 to Lui et al. and entitled "Lighting Fixture with Reflector and Template PCB" describes other issues prevalent in SSL lighting, such as heat dissipation issues not described herein, emitter connection methods and structures and emission distribution tailoring. This application is fully incorporated herein by reference.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain configurations thereof, other versions are possible. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in the claims.

We claim:

1. A lighting fixture, comprising:

an array of emitters on a mount area of a heat sink, said heat sink comprising a plurality of fins extending from an inner portion of said heat sink to an outer portion of said heat sink; and a driver box for housing drive electronics to drive said array of emitters, said driver box comprising at least one attachment portion, said driver box mounted to said heat sink by said at least one attachment portion, said driver box adjacent to said plurality of fins at said outer portion of said heat sink, wherein said driver box is shaped to correspond with a side surface of said outer portion of said heat sink.

2. The fixture of claim 1, wherein a central vertical axis of said driver box is offset from a central vertical axis of said array.

3. The fixture of claim 1, wherein said array comprises a perimeter; and wherein said driver box is outside said perimeter.

4. The fixture of claim 3, wherein said driver box is completely outside said perimeter.

5. The fixture of claim 1, wherein said driver box horizontally offset from said array.

6. The fixture of claim 1, wherein no portion of said driver box is directly over said array.

7. The fixture of claim 1, wherein said array is in the center of said heat sink.

8. The fixture of claim 1, wherein said heat sink is shaped to define airways from a bottom surface of said heat sink to a top surface of said heat sink.

9. The fixture of claim 1, wherein said array and said driver box are approximately level.

10. The fixture of claim 1, comprising first and second driver boxes;

wherein each of said first and second driver boxes is horizontally offset from said array.

11. The fixture of claim 1, comprising first and second driver boxes;

wherein each of said driver boxes is on the periphery of said heat sink.

12. The fixture of claim 1, further comprising a junction box;

wherein said junction box is horizontally offset from said array.

13. The fixture of claim 1, wherein said driver box is remote to said array.

14. The fixture of claim 1, wherein said fixture is configured to emit about 18,000 lumens or more at an efficacy of about 90 lm/W or more.

15. The fixture of claim 1, wherein said fixture is configured to emit about 23,000 lumens or more at an efficacy of about 100 lm/W or more.

16. A lighting fixture, comprising:

a heat sink with one or more emitters thereon and comprising a plurality of fins and an outer side surface, said emitters comprising a first primary thermal dissipation path; and a driver box comprising drive electronics for driving said one or more emitters, said driver box comprising at least one attachment portion, wherein said driver box is mounted to said heat sink by said at least one attachment portion such that said driver box comprises a side surface which is adjacent to said plurality of fins, wherein said side surface of said driver box is shaped to correspond to the shape of said outer side surface of said heat sink;

wherein said first primary thermal dissipation path of said emitters does not substantially pass through said driver box.

17. The fixture of claim 16, wherein said driver box comprises a second primary thermal dissipation path; and wherein said first and second primary dissipation paths do not substantially overlap.

18. The fixture of claim 16, wherein said driver box is horizontally remote to said emitters.

19. The fixture of claim 16, wherein said driver box is on the periphery of said heat sink.

20. The fixture of claim 16, wherein said driver box comprises a second primary thermal dissipation path; and wherein said second primary thermal dissipation path passes directly from said driver box into the ambient.

21. The fixture of claim 16, wherein said driver box comprises a second primary thermal dissipation path;

wherein said first primary thermal dissipation path enters the ambient at a first point; and wherein said second primary thermal dissipation path enters the ambient at a second point remote from said first point.

22. A heat sink for use in a lighting fixture, said heat sink comprising:

an inner level spoke; and a plurality of outer level spokes;

wherein at least two of said outer level spokes emanate from said inner level spoke, each of said spokes comprising a top surface, said spoke top surfaces being coplanar;

wherein said heat sink comprises a plurality of bottom openings and a plurality of side openings, wherein a portion of said heat sink separates said side openings and said bottom openings such that said side openings are distinct from said bottom openings.

23. The heat sink of claim 22, wherein at least three of said outer level spokes emanate from said inner level spoke.

24. The heat sink of claim 22, further comprising two second level spokes between said inner level spoke and said outer level spokes.

25. The heat sink of claim 24, wherein at least four of said outer level spokes emanate from said inner level spoke.

26. The heat sink of claim 24, wherein at least two of said outer level spokes emanate from each of said second level spokes.

27. The heat sink of claim 22, wherein said spokes are thermally conductive.

28. The heat sink of claim 22, wherein said heat sink is shaped to define spaces between adjacent ones of said spokes.

29. The heat sink of claim 28, wherein at least some of said spaces are open to the ambient below said heat sink.

30. The heat sink of claim 28, wherein said spaces between adjacent ones of said outer level spokes are open to the ambient below said heat sink.

31. The heat sink of claim 28, wherein at least some of said spaces are airways from a bottom surface of said heat sink to a top surface of said heat sink.

32. The heat sink of claim 22, wherein said heat sink comprises a safety ring connecting adjacent ones of said outer level spokes.

33. The heat sink of claim 22, wherein said heat sink is shaped to define a plurality of bottom openings and a plurality of side openings.

34. The heat sink of claim 22, further comprising a junction between said inner level spoke and said outer level spokes;

wherein said junction is cylindrical.

35. The heat sink of claim 22, comprising a plurality of inner level spokes;

wherein at least two of said outer level spokes emanate from each of said inner level spokes.

36. The heat sink of claim 35, wherein said inner level spokes emanate from a central point.

37. The heat sink of claim 36, wherein said inner level spokes meet at said central point.

38. The heat sink of claim 36, wherein said central point is devoid of spokes.

39. A lighting fixture, comprising:

a heat sink comprising:

an inner level spoke; and a plurality of outer level spokes;

wherein at least two of said outer level spokes emanate from said inner level spoke;

wherein said heat sink is shaped to define a plurality of bottom openings and a plurality of side openings, wherein a portion of said heat sink separates said side openings and said bottom openings such that said side openings are distinct from said bottom openings; and one or more emitters mounted on a surface of said heat sink opposite said spokes.

40. The fixture of claim 1, wherein said heat sink and said driver box each comprise top and bottom surfaces, at least one of said heat sink's top or bottom surfaces being substantially co-planar with the corresponding surface of said driver box.

41. A lighting fixture, comprising:

an array of emitters on a first side of a heat sink, said heat sink comprising a plurality of inner fins, said heat sink comprising at least two outer fins emanating from one of said plurality of inner fins, said one of said plurality of inner fins and said at least two outer fins each comprising a surface forming at least part of a second side of said heat sink, said second side of said heat sink opposite said first side of said heat sink, said surfaces being coplanar; and a driver box for housing drive electronics to drive said array of emitters, wherein said driver box is adjacent to an outer portion of said heat sink.

42. The lighting fixture of claim 41, wherein each of said plurality of inner fins extends beyond a perimeter of said array of emitters.

43. The lighting fixture of claim 41, wherein said driver box is mounted adjacent to at least two or more of said plurality of inner fins.

44. The lighting fixture of claim 41, wherein said driver box is on a surface of said heat sink between said first and second sides.

45. The lighting fixture of claim 41, wherein said heat sink comprises a plurality of inner fins each with at least two outer fins emanating therefrom.

* * * * *